US010280602B2

(12) United States Patent
Tang

(10) Patent No.: US 10,280,602 B2
(45) Date of Patent: May 7, 2019

(54) BOWL FLUSHING CONTROL DEVICE OF LOW TANK TYPE TOILET

(71) Applicant: Yaping Tang, Wuhan (CN)

(72) Inventor: Yaping Tang, Wuhan (CN)

(73) Assignee: XIAMEN R&J PRECISION TECHNOLOGY CO., LTD., Xiamen (CN)

( * ) Notice: Subject to any disclaimer, the term of this patent is extended or adjusted under 35 U.S.C. 154(b) by 0 days.

(21) Appl. No.: 15/578,143

(22) PCT Filed: May 31, 2016

(86) PCT No.: PCT/CN2016/084042

§ 371 (c)(1),
(2) Date: Nov. 29, 2017

(87) PCT Pub. No.: WO2016/192614

PCT Pub. Date: Dec. 8, 2016

(65) Prior Publication Data

US 2018/0142454 A1 May 24, 2018

(30) Foreign Application Priority Data

Jun. 1, 2015 (CN) ..... 2015 1 0294161

(51) Int. Cl.
*E03D 1/24* (2006.01)
*E03D 1/32* (2006.01)

(52) U.S. Cl.
CPC *E03D 1/24* (2013.01); *E03D 1/32* (2013.01)

(58) Field of Classification Search
CPC ..... E03D 1/24; E03D 1/32
USPC ..... 4/420.1, 329, 331
See application file for complete search history.

(56) References Cited

U.S. PATENT DOCUMENTS 6,679,287 B2 1/2004 Huang
2003/0213053 A1 11/2003 Huang
2013/0185859 A1* 7/2013 Yu ..... E03D 1/32 4/415
2014/0048157 A1* 2/2014 Fu ..... E03D 1/32 137/409

(Continued)

FOREIGN PATENT DOCUMENTS

CN 2825772 Y 10/2006
CN 103104014 A 5/2013

(Continued)

*Primary Examiner* — Huyen Le
(74) *Attorney, Agent, or Firm* — Rabin & Berdo, P.C.

(57) ABSTRACT

A bowl flushing control device of low tank type toilet has a water supply pipe with a working chamber; a waterway switch component used to open and close the waterway of the water supply pipe; a first floater being floatable in the toilet tank, the first floater takes action when the water level in the water tank is lower than the working level; a control rod being movable up and down, the first floater is movably coupled to the control rod; the control rod is movably connected to the waterway switch component to move downwardly and drive the waterway switch component to close the waterway of the water supply pipe when the first floater takes off restriction on the control rod; a activation component used to control the control rod to move upwardly to reset and coupled to the control rod.

13 Claims, 33 Drawing Sheets

(56) References Cited

U.S. PATENT DOCUMENTS

2016/0168834 A1* 6/2016 Magar ..... E03D 1/32
137/434

FOREIGN PATENT DOCUMENTS

CN 103122653 A 5/2013
JP H06146366 A 5/1994

* cited by examiner

BOWL FLUSHING CONTROL DEVICE OF LOW TANK TYPE TOILET

FIELD OF THE INVENTION

The present invention relates to a low tank toilet, particularly to a bowl flushing control device of low tank type toilet.

BACKGROUND OF THE INVENTION

Traditional toilet disposes the tank on the seat body. Due to the water gravity, water in the tank easily enters the flushing ring passage of the toilet to flush the bowl. But this kind of toilet occupies large space, and it is not convenient for package and transportation and it costs high. Therefore, there is a kind of toilet with low tank; the tank is disposed at the interior portion of the rear side of the seat body that it reduces much occupying space. However, this low tank type toilet has disadvantages: the height difference between the water level in the tank and the lip portion of the toilet (the flushing ring portion) is small, even the water level in the tank is lower than the lip portion, resulting in that when water flushes, the tank can provide enough water to satisfy the bowl flushing need.

A patent application is disclosed in the Chinese patent database with publishing number CN103104014A and title a lip portion water supply converting device of a low tank type toilet, in which the flushing water from the inlet valve is guided to the lip portion of the toilet to flush the bowl of the toilet by components like clean water supply pipe (110), supply water converting component (130), water level adjusting component (150), float ball (160), floater (240), pipes (220), etc. However, this low tank toilet still has disadvantages: the pipe body (220) is connected to the inlet valve and the tank, so water level of the clean water flushing pipe (110) and the water level of the tank directly influence the water level in the pipe (220), the inlet water from the inlet valve provides pump force to the water in the pipe (220), water in the pipe (220) is directly pumped to the toilet. That is to say, when in work state, the water level in the pipe is influenced only a bit by the water level in the tank but a lot by inlet pressure and the pump force of the inlet valve. The floater (240) in the pipe (220) senses the water level in the pipe but not the water level in the tank to float up and down. Therefore, the inlet pressure of the inlet valve and the pump performance directly influence the water level in the pipe, and influencing the switch of the water supply switch component. Namely the water supply switch device provides different supply water converting volumes in different working pressure with the same set of inlet valve and discharging valve. During flushing the ring passage, it may lead to bad flushing effect when the water supply volume is not enough or waste water when the water supply volume is abundant. In addition, this solution has disadvantages of many components and complicated structure.

SUMMARY OF THE INVENTION

The present invention is provided with a bowl flushing control device of low tank type toilet, which overcomes the technical problem of the water supply converting device of the lip portion of the low tank toilet of the existing technology.

The technical solution of the present invention is that:

A bowl flushing control device of low tank type toilet, wherein comprising:

In another preferred embodiment, the waterway of the water supply pipe corresponding to the front side of the working chamber is disposed with a spraying nozzle, and/or the waterway of the water supply pipe corresponding to the front side of the working chamber is disposed with a relief valve.

Compared to the existing known technology, the present invention has following effects:

1. The present invention can not only guide the flushing water from the inlet valve to the flushing ring passage of the toilet the flush the bowl of the toilet during discharging, but also bring the effects: the first floater is directly disposed in the toilet tank, to directly sense the height of the water level in the tank, and the present invention uses the first floater to restrict on the control rod to make the switch point of close of the waterway switch component completely controlled by the first floater and none business with the inlet pressure of the inlet valve and other components. Therefore, the varied of the inlet pressure influences little, with the same inlet valve and discharge valve, based on a good flushing effect, the present invention has advantages of stable discharge volume, free of place and working pressure and wide applicability.

2. The present invention has advantages of small and compact structure, less components and low sealing need, thus decreasing the manufacturing difficulty of the product and greatly increasing the yield of the products.

3. The present invention is further disposed with two water replenishing passages and a water replenishing adjust piece, making the water replenishing volume adjustable for different toilets, protruding a good applicability for various toilets.

4. The waterway switch component of the present invention is preferred a water stop plate with its axis parallel to or vertical to its rotating axis that brings advantages that the water stop plate needs to rotate in a large angle to completely open or close the waterway of the water supply pipe, therefore the space is small that benefits a smaller size and compacter structure of the entire structure.

The present invention will be further described with the drawings and embodiment; but it should be noted that the scope of the present invention is not limited to the embodiments.

DETAILED DESCRIPTION OF THE EMBODIMENTS

The First Embodiment

Figure 1:
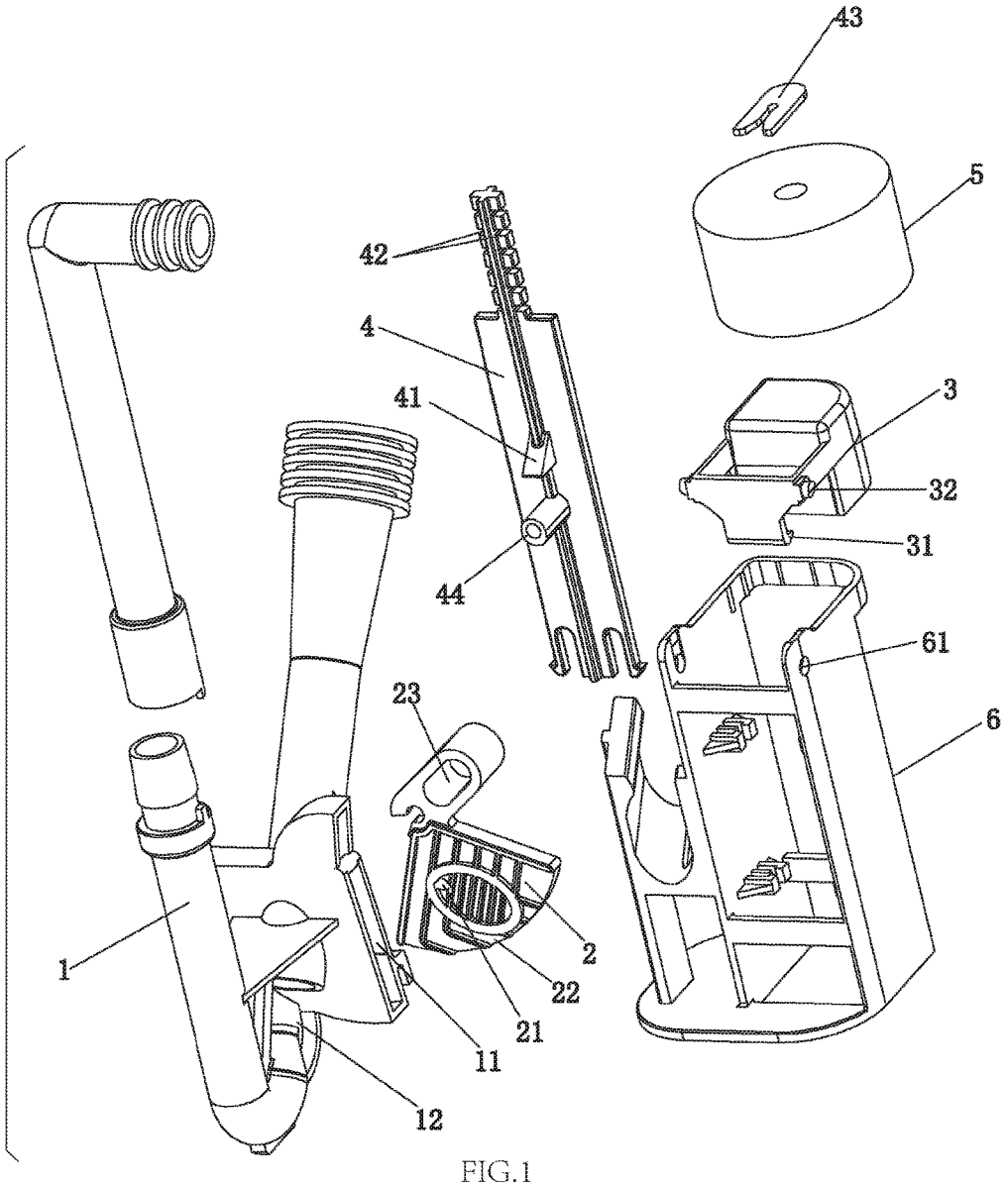
FIG. 1 illustrates an exploded diagram of a first embodiment of the present invention.
Figure 2:
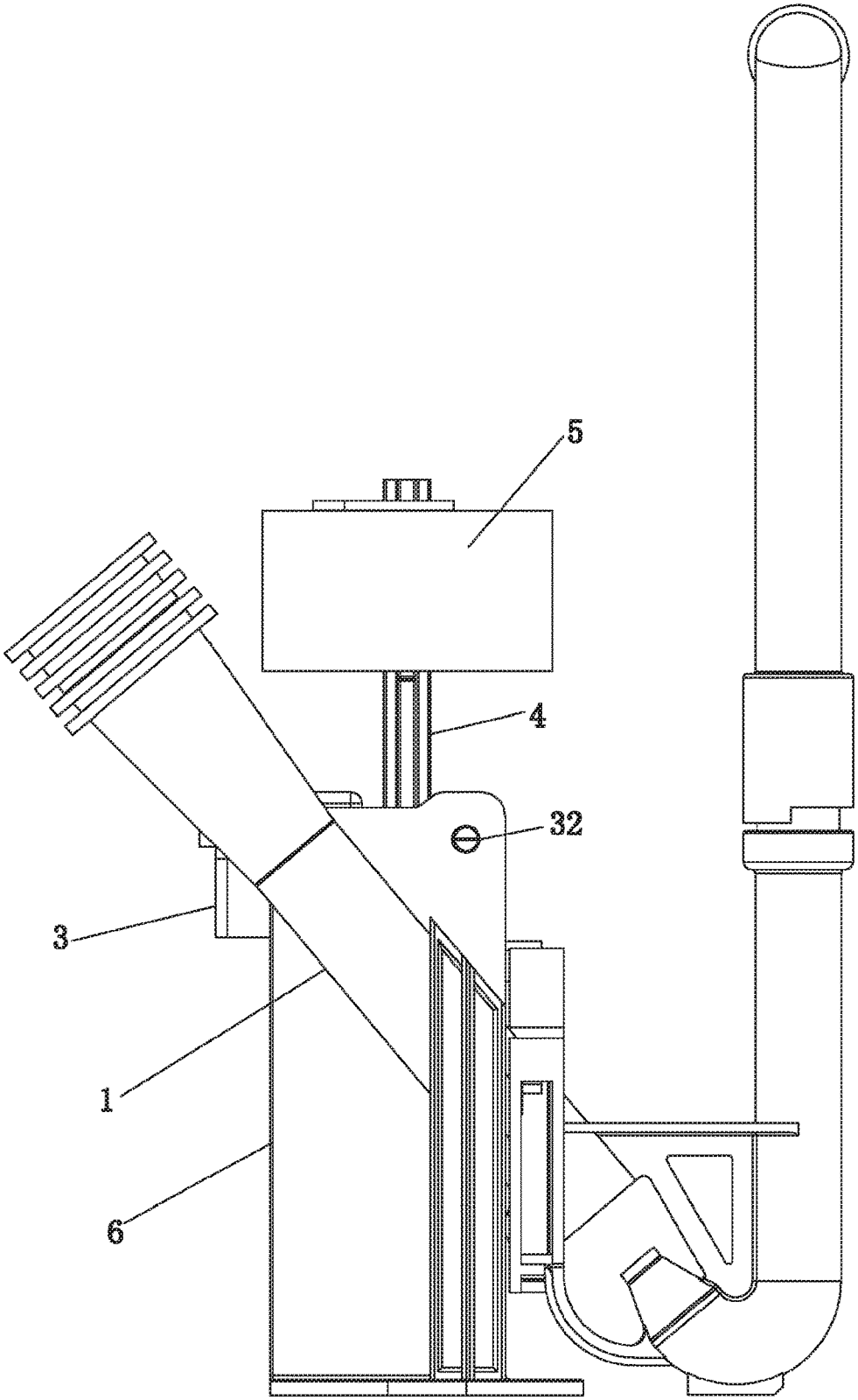
FIG. 2 illustrates a schematic diagram of the first embodiment of the present invention.
Figure 3:
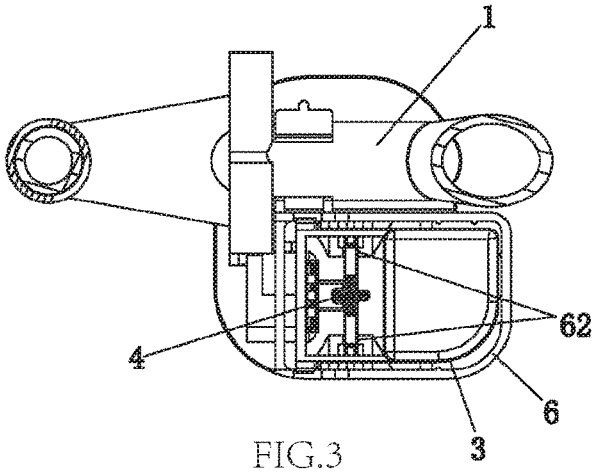
FIG. 3 illustrates a lateral sectional diagram of the first embodiment of the present invention.

Referring to FIGS. 1-7, a bowl flushing control device of low tank type toilet comprises:

a water supply pipe 1 used to supply flushing water from an inlet valve to the flushing ring passage or the connecting pipes, the water supply pipe 1 is disposed with a working chamber 11, the working chamber 11 is connected to the waterways at two sides of the water supply pipe 1 and the toilet tank; herein, the two waterways at two sides of the water supply pipe mean that the interior of the water supply pipe 1 is divided to two portions of waterways by the working chamber, the two portions of waterways are connected by the working chamber; the side surface of the water supply pipe 1 is further disposed with a connecting hole 12, which is disposed at the front side of the working chamber 11 and connects the toilet tank and working chamber 11;

a waterway switch component rotatably assembled to the working chamber 11 to open and close the waterway of the water supply pipe 1, the flushing water is stored in the toilet tank when the waterway switch component closes the waterway of the water supply pipe through the connecting hole 12;

a first floater being floatable in the toilet tank, the first control component is a rack 6 disposed in the toilet tank, the first floater takes action when the water level in the water tank is lower than the working level;

a control rod 4 being movable up and down, the first floater is movably coupled to the control rod 4, the first floater restricts the control rod 4 from moving downwardly before the first floater takes corresponding action; the control rod 4 is movably connected to the waterway switch component to move downwardly and drive the waterway switch component to close the waterway of the water supply pipe 1 when the first floater takes off restriction on the control rod 4;

an activation component being coupled to the control rod 4 to control the control rod 4 to move upwardly to reset and to drive the waterway switch component to open the waterway of the water supply pipe 1.

This embodiment further comprises a water replenishing structure to replenish water to the toilet; the water replenishing structure comprises a water replenishing hole 21 at the waterway switch component to replenish water to the flushing ring passage of the toilet when the waterway switch component closes the waterway of the water supply pipe 1.

In this embodiment, the waterway switch component is a water stop plate 2, the axis of the water stop plate 2 is parallel to the rotation axis of the water stop plate 2. One end face of the water stop plate 2 is disposed with a guide groove 22 to guide the flushing water to the toilet tank when the water stop plate 2 closes the waterway of the water supply pipe 1. The water stop plate 2 is fanshaped. The shape of the working chamber 1 of the water supply pipe 1 is coupled to the shape of the water stop plate 2. the side surface of the working chamber 11 is disposed with an opening; the center of circle of the water stop plate 2 is disposed with a rotation shaft rotatably connected to the upper side of the opening of the working chamber 11 to make the water stop plate 2 rotate in or out of the working chamber 11 form the opening at the side surface of the working chamber 11.

In this embodiment, the center of circle of the water stop plate 2 is extending with a first connecting portion, the first connecting portion is disposed with an elongate hole 23, the side surface of the control rod 4 is disposed with a lifting lever 44, the lifting lever 44 is slidably inserted to the elongate hole 23.

In this embodiment, the first floater is a float bowl 3, one side of which is disposed with a horizontal rotating shaft 32, the top portion of the rack 6 is corresponding disposed with two shaft holes 61, the rotating shaft 32 is rotatably connected to the two shaft holes 61 to make the floating bowl 3 rotatably connected to the rack 6 and make the rotating shaft 32 rotate when the water level in the toilet tank is lower than the working level.

In this embodiment, the side surface of the control rod 4 is disposed with a protruding portion 41, the external side surface of the protruding portion 41 is disposed with a guide incline surface faced upwardly, the floating bowl 3 is disposed with a hook 31 to hang to the protruding portion 41, the hook 31 hooks the protruding portion 41 before the float bowl 3 rotates so as to restrict the control rod 4 from moving downwardly.

In this embodiment, the activation component is a second floater 5 assembled to the top portion of the control rod 4. The second floater is a floater 5. The opposite two side surfaces of the top portion of the control rod 4 are respectively disposed with a plurality of lock grooves 42 from up to down, the lock grooves 42 at two sides are aligned one by one. The floater 5 is disposed with the passage throughout up and down. The floater 5 is sleeved on the top portion of the control rod 4 by the passage, the upper side of the floater 5 uses a U shaped lock catch 43 to lock to two of the lock grooves 42 at the top portion of the control rod 4 to achieve position limit. In addition, the height of the floater 5 is adjustable. Two U shaped lock catches are coupled to lock grooves of the control rod to limit the position of the upper side and lower side of the floater 5.

In this embodiment, the side surface of the interior of the rack 6 is disposed with a guide groove 62, the control rod 4 is movably assembled to the rack 6, the guiding groove 62 moves up and down in relation to the control rod 4 to achieve direction guiding.

In this embodiment, the water supply pipe 1 comprises two pipe sections, one of which is used to connected to the inlet valve, the other one is used to connected to the flushing water passage of the toilet and is disposed with above mentioned working chamber 11 and the connecting hole 12.

In this embodiment, the float bowl 3 can be replaced by a floater or a float ball. The floater 5 above mentioned can be replaced by a float bowl or a float ball. The water stop plate 2 and its shape are preferred for the present invention. It should be noted that, the waterway switch component of the present invention is not limited to the water stop plate 2 and its shape, and other component with other shape are also available, for example, a water stop plate with non-fan-shaped, or a water stop component with non-plate shaped.

Figure 4:
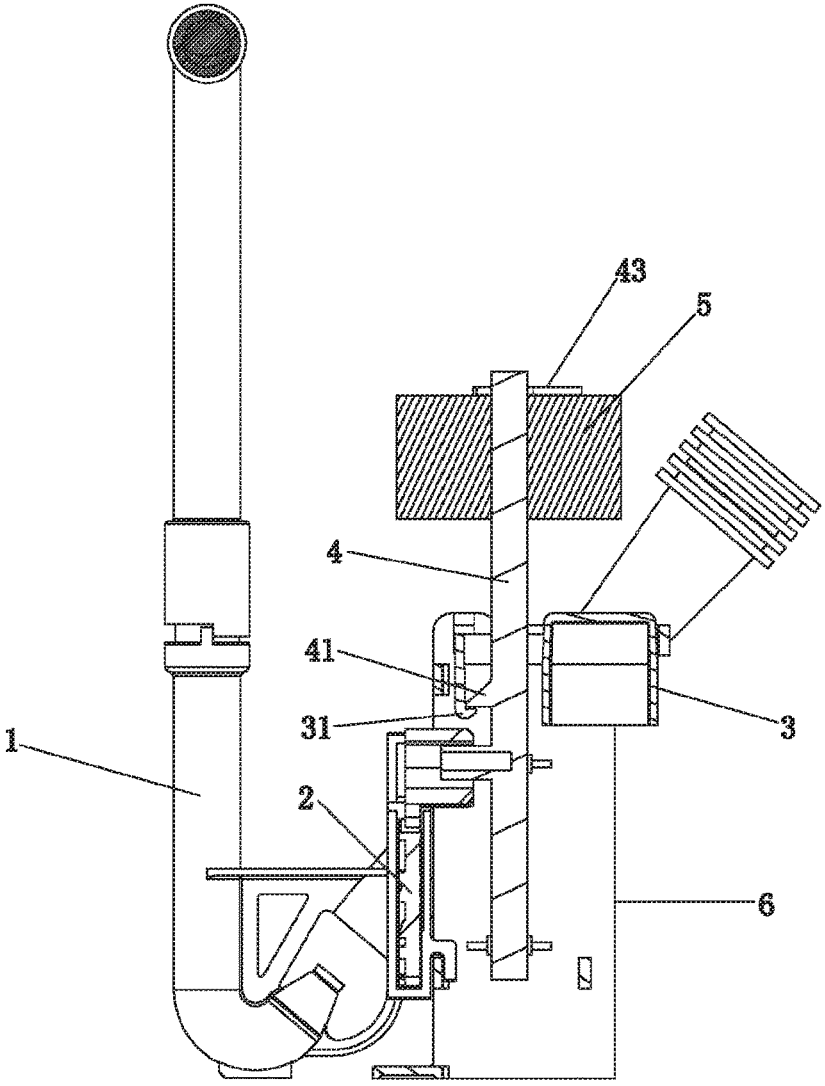
FIG. 4 illustrates a longitudinal sectional diagram of the first embodiment of the present invention when the waterway switch component is in open state.
Figure 5:
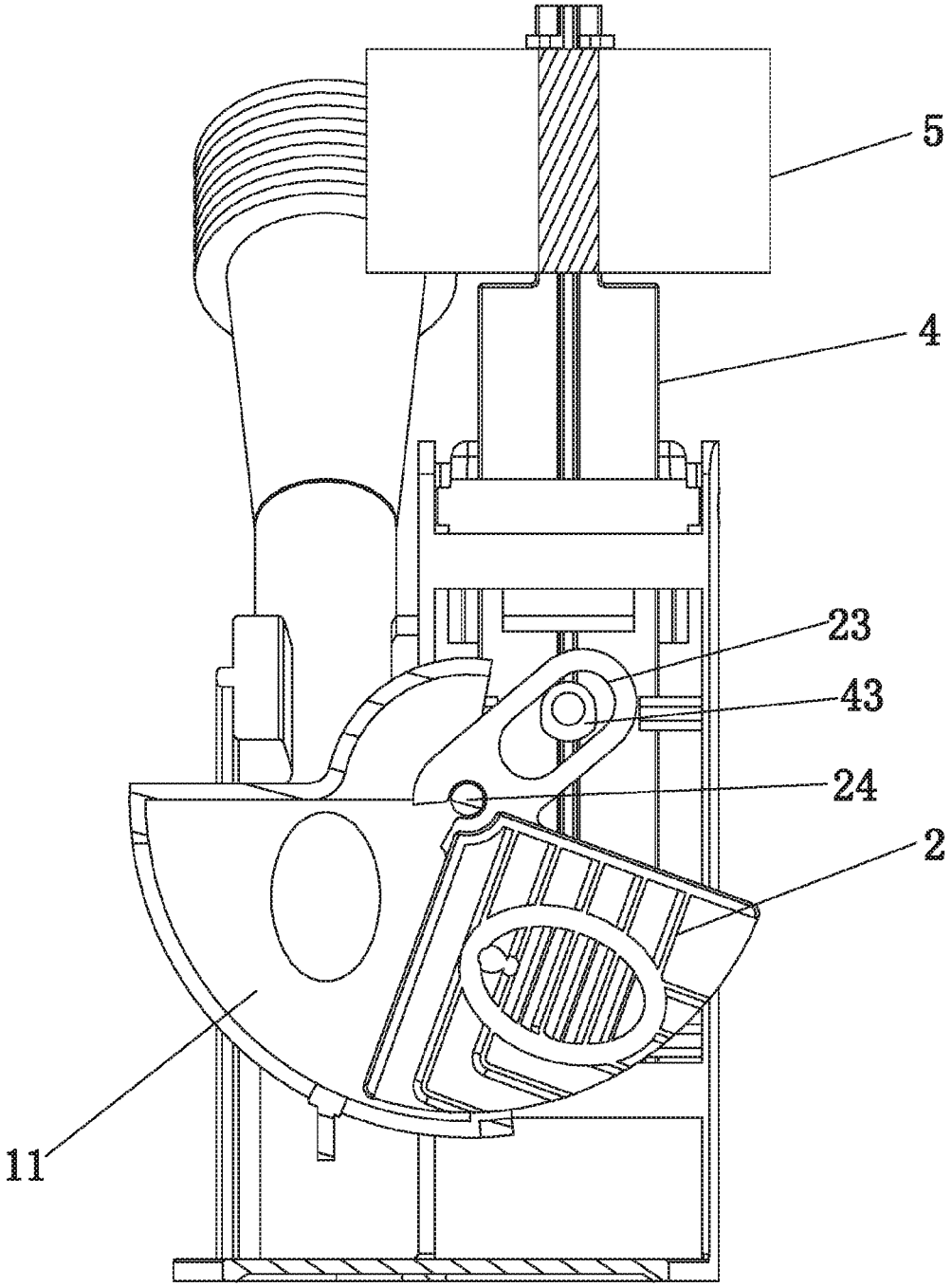
FIG. 5 illustrates a second longitudinal sectional diagram of the first embodiment of the present invention when the waterway switch component is in open state.
Figure 6:
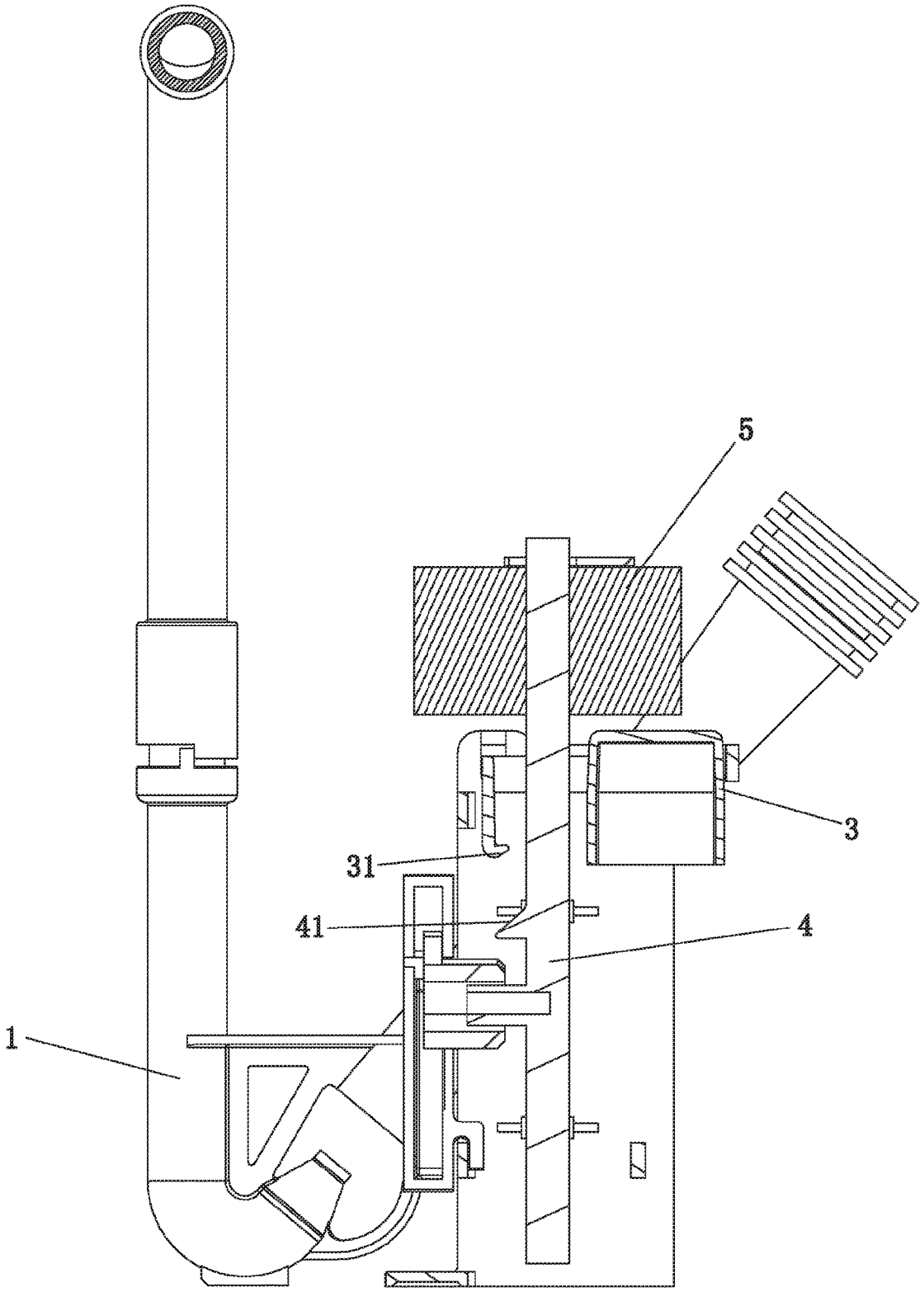
FIG. 6 illustrates a longitudinal sectional diagram of the first embodiment of the present invention when the waterway switch component is in close state.
Figure 7:
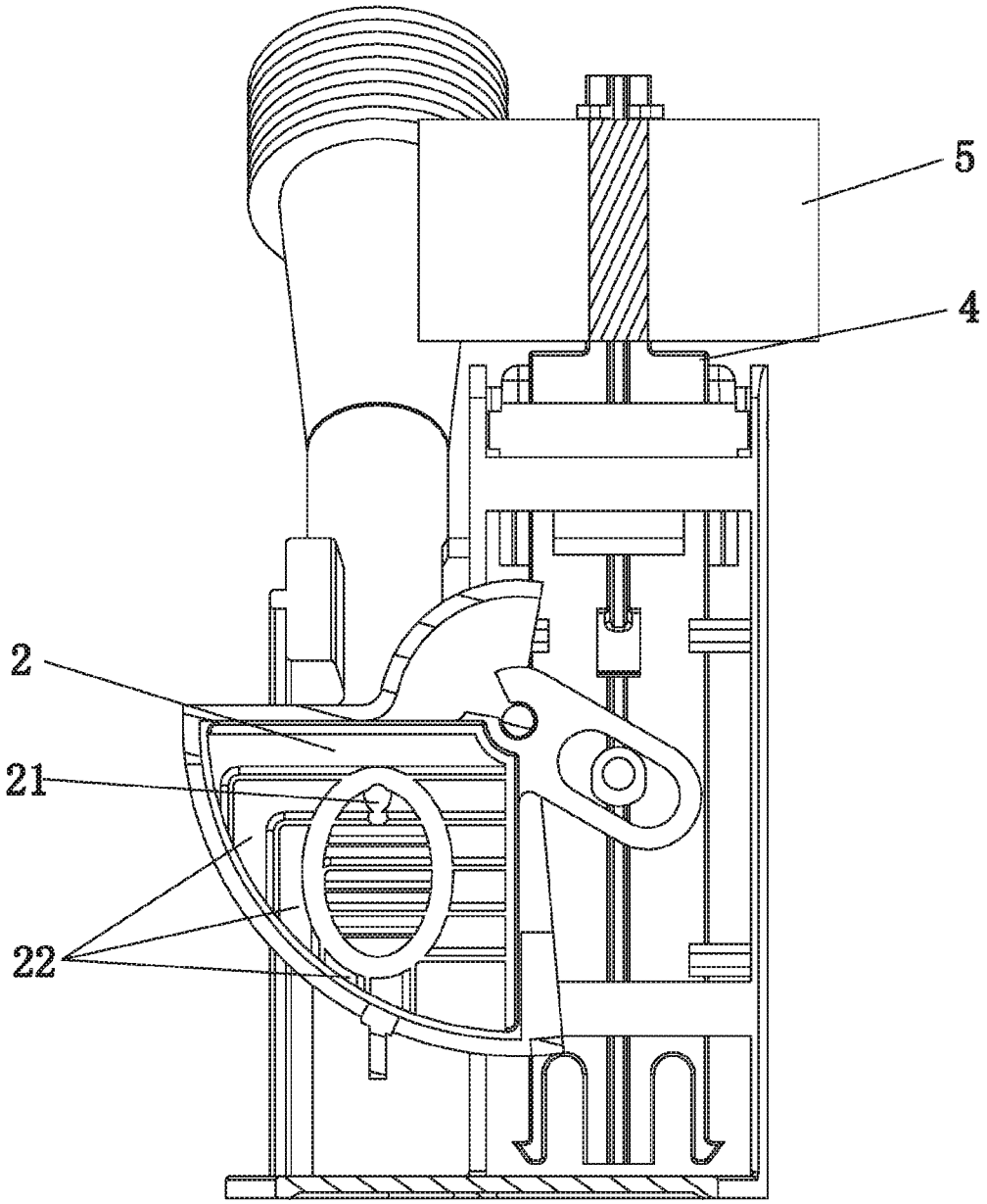
FIG. 7 illustrates a second longitudinal sectional diagram of the first embodiment of the present invention when the waterway switch component is in close state.
Figure 8:
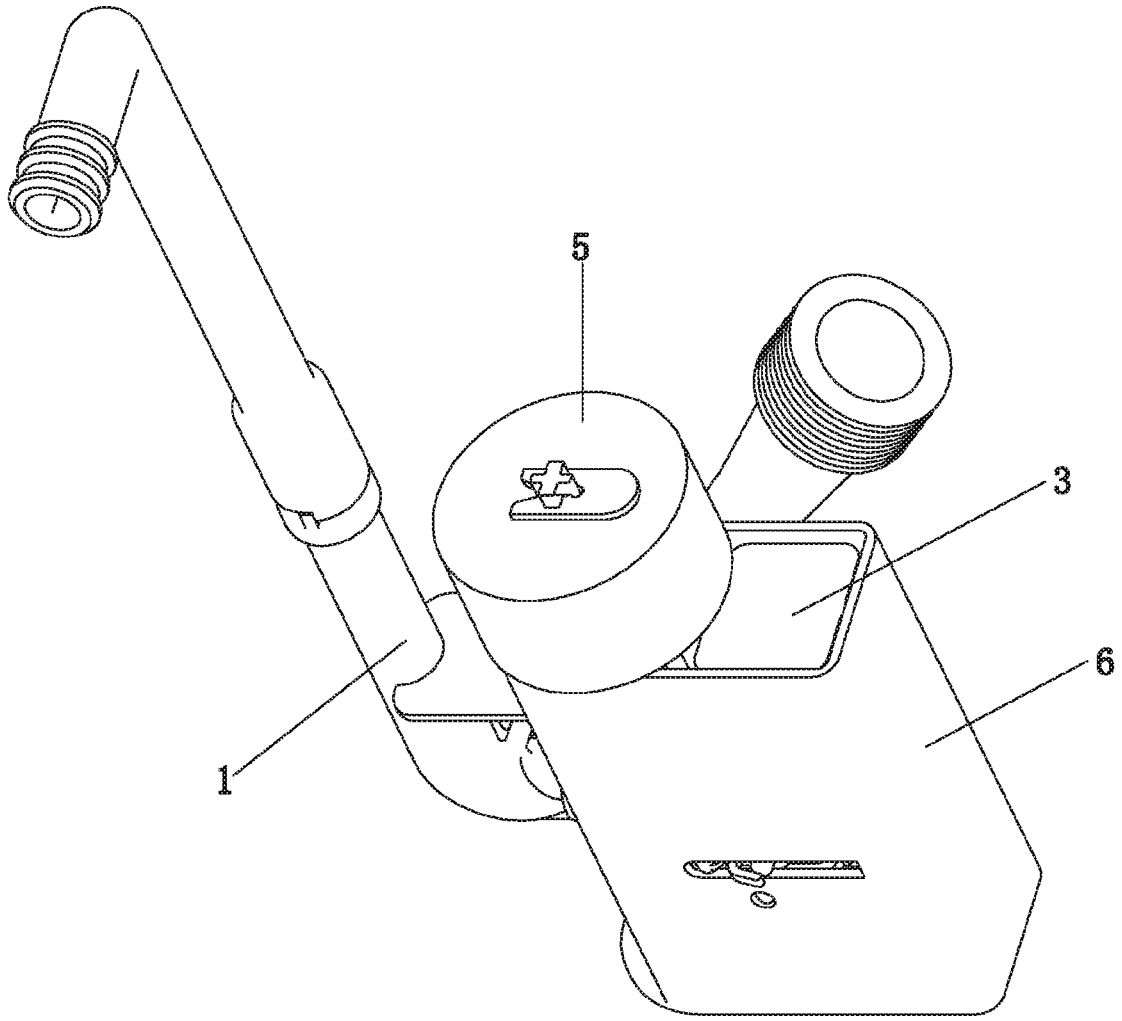
FIG. 8 illustrates a schematic diagram of a second embodiment of the present invention.

The working process of the bowl flushing control device of low tank type toilet of the present invention is that:

Before flushing the toilet bowl, the float bowl 3 and the floater 5 are floating, the water stop plate 2 is open, the hook 31 of the float bowl 3 hangs to the protruding portion 41 of the control rod 4, as figured in FIG. 4 and FIG. 5;

When flushing the toilet bowl, the discharge valve works to discharge water in the tank to the spraying passage of the toilet, water level in the tank lowers down and the inlet valve is driven to inlet water; when water flows out of the inlet valve, the flushing water is supplies to the water supply pipe 1, at the same time, water in the tank is absorbed to the water supply pipe 1 through the opening of the working chamber 11 of the water supply pipe 1 and flushes to the flushing ring passage with the flushing water of the inlet valve to flush the bowl of the toilet; after the discharge valve is closed, the water supply pipe 1 continuously supplies water to the toilet. Before the water level in the tank lowers to the working level of the float bowl 3, the float bowl 3 keeps in floating state, making the hook 31 hook to the protruding portion 41 of the control rod 4, the control rod 4 does not fall down, the water stop plate 2 still keeps in open. With the water level in the tank continuously lowers (lower than the working level of the float bowl 3), the float bowl 3 rotates in the clockwise direction, making the control rod 4 escape from hooking, during this process, the floater lowers with the lowering of the water level in the tank and drives the water stop plate 2 to rotate in the clockwise direction till the internal waterway of the water supply pipe 1 is closed with the gravity of the control rod 4, as figured in FIG. 6 and FIG. 7. At this time, the inlet valve keeps inlet, most of flushing water is stored in the toilet tank through the guide groove 22 of the water stop plate 2, a small amount of flushing water flows to the flushing ring passage of the toilet to replenish water to the toilet through the water replenishing hole 21 of the water stop plate 2 and the water supply pipe 1.

During the water storing process, water level in the tank gradually raises. When the water level in the tank is higher than the lowest working level of the float bowl 3, the float bowl 3 rotates in the counter-clockwise direction until it completely floats up. At this time, as the inlet valve still inlets water, it provides a pull force for the water stop plate 2 to rotate in the clockwise direction and indirectly provides a pull force of downward for the control rod 4, and when the water level in the tank submerges the floater 5, the pull force is still larger than the float force of the floater 5, making the water supply pipe 1 keep in close, the tank continuously stores water.

After water storing finishes, the impact force of the inlet water of the inlet valve to the water stop valve 2 disappears, the float force on the floater 5 is larger than the gravity of the floater 5 and the control rod 4, the floater 5 drives the control rod 4 to float up and pulls the water stop plate 2 to rotate in the counter clockwise direction to completely open for next time's discharge. During the control rod 4 floats up, the guide incline surface of the protruding portion 41 contacts the hook 31 of the float bowl 3 and continuously floats up with the control rod 4, the guide incline surface of the protruding portion 41 pushes the hook 31 of the float bowl 3 to swing in a small amount, making the protruding portion 41 move up and pass the hook 31 of the float bowl 3 and finally hook to the hook 31 of the float bowl 3, thus resetting to the initial state before flushing, as figured in FIG. 4.

The bowl flushing control device of low tank type toilet of the present invention is provided that, during the flushing, the working state of the float bowl 3 is completely influenced by the water level in the water tank but none with the inlet pressure of the inlet valve; the floater 5 just provides the float force for the control rod 4 to float up, but it does not decide the floating time of the control rod 4, that is to say, when the water stop plate 2 opens, water inlets, the inlet water impacts the water stop plate 2 to provide a pull force to prevent the floater from floating up in advance, therefore guaranteeing the switch point of the water supply pipe 1 to open is the water stop time of the inlet valve in any pressure. Therefore, the varied of the inlet pressure influences little, with the same inlet valve and discharge valve, based on a good flushing effect, the present invention has advantages of stable discharge volume, free of working place and working pressure and wide applicability.

The Second Embodiment

Referring to FIGS. 8-12, this embodiment differs from the first embodiment in that: The first floater (the float bowl 3) is longitudinally movably assembled to the rack 6, and it moves downwardly when the water level in the toilet tank is lower than the working level; a transmission mechanism 7 is further provided, the float bowl 3 is linked to the control rod 4 by the transmission mechanism 7.

In this embodiment, the transmission mechanism 7 comprises a slide block 71 horizontally slidably assembled to the rack 6, a driving component 73 rotatably assembled to the rack 6 and an elastic element; the side surface of the control rod 4 is disposed with a protruding portion similar to the first embodiment, the slide block 71 is disposed with a hanging portion 74 to hang to the protruding portion 41, the external side surface of the hanging portion 74 is disposed with a guide incline surface faced downwardly; one end of the driving component 73 is movably connected to the float bowl 3, the other end of the driving component 73 is contacted with the slide block 71 to make the float bowl 3 push the slide block 71 to move that makes the hanging portion 74 of the slide block 71 separate from the protruding portion 41 when the float bowl 3 moves downwardly; the slide block 71 resets by the elastic element. In detailed, the elastic element is a torsion spring 72 assembled to the rotating shaft of the driving component 73, two ends of the torsion spring 72 respectively abut against the driving component 73 and the slide block 71. In another case, the elastic element can be a spring, the spring is connected between the slide block 71 and the internal side wall of the rack 6.

Figure 9:
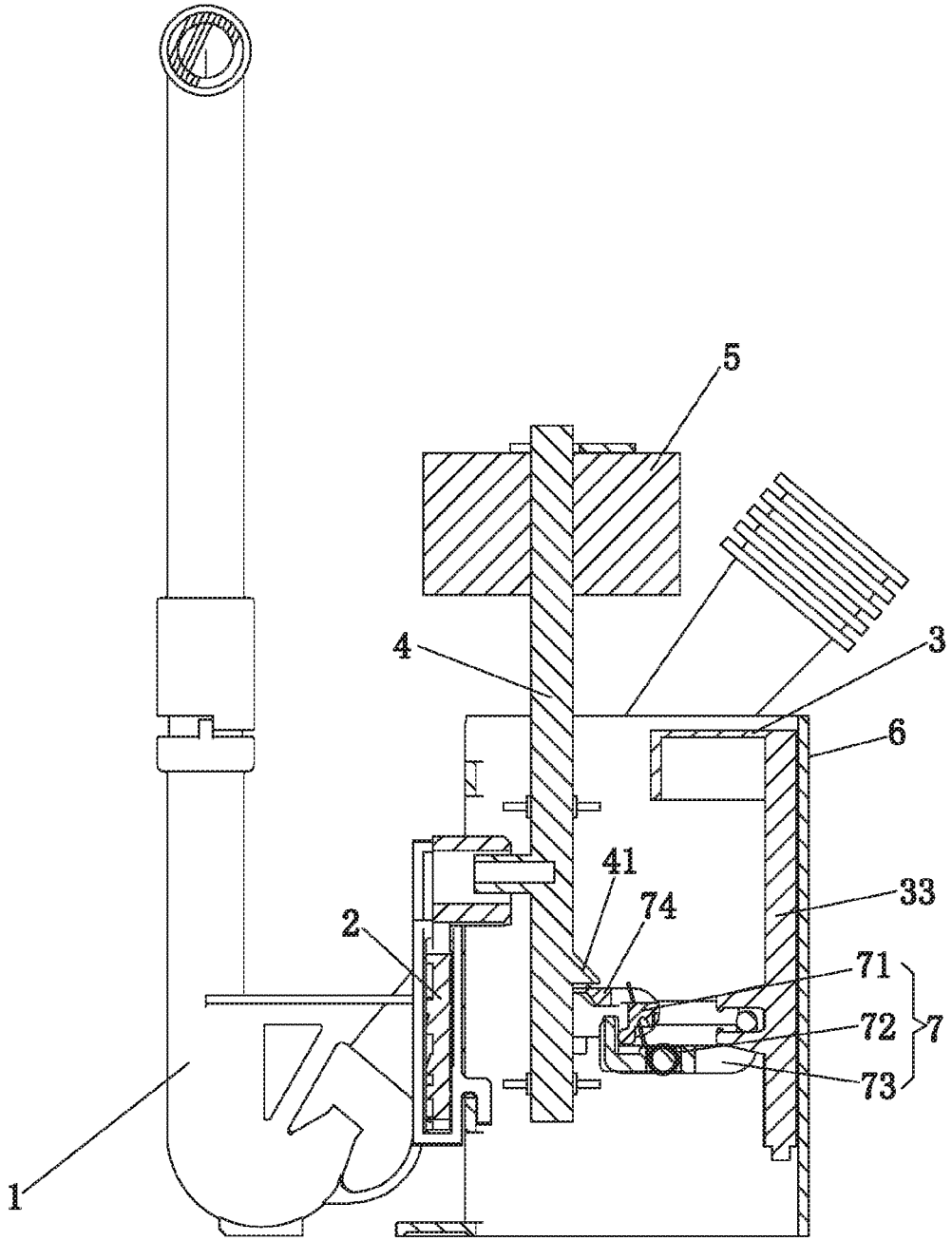
FIG. 9 illustrates a longitudinal sectional diagram of the second embodiment of the present invention when the waterway switch component is in open state.
Figure 10:
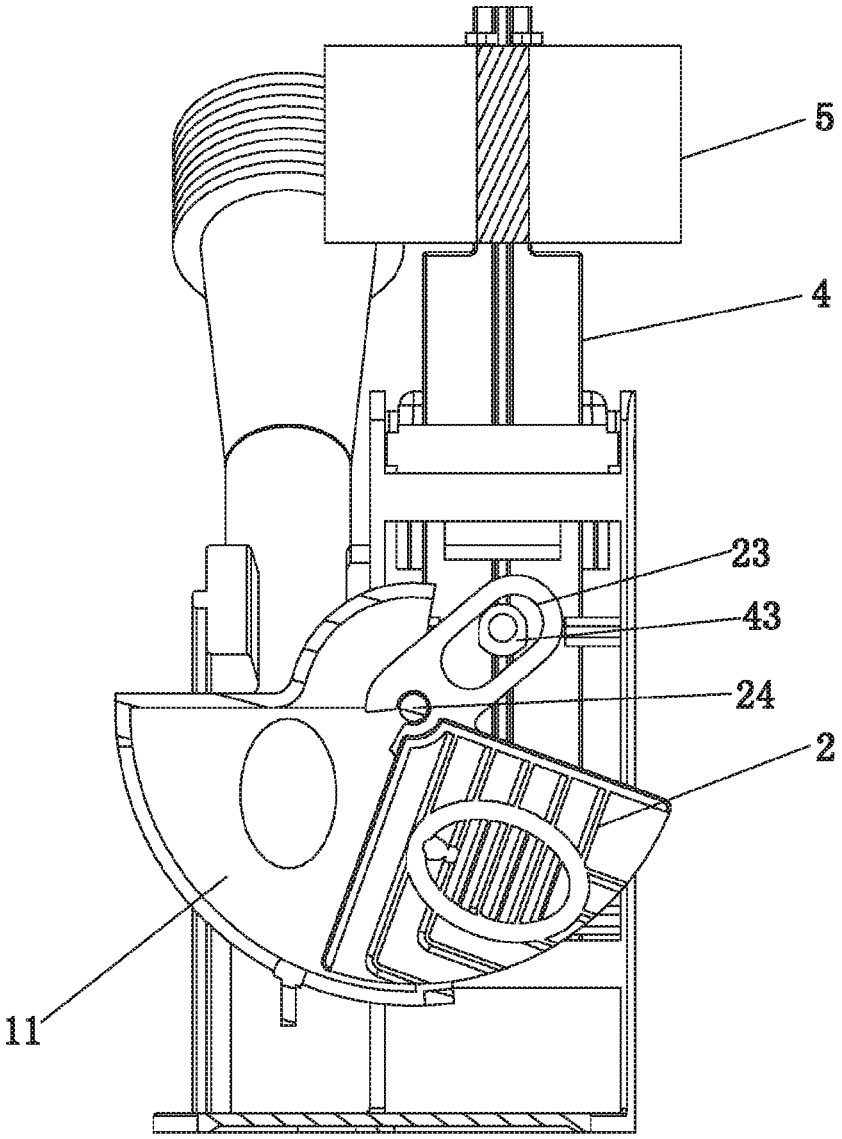
FIG. 10 illustrates a second longitudinal sectional diagram of the second embodiment of the present invention when the waterway switch component is in open state.
Figure 11:
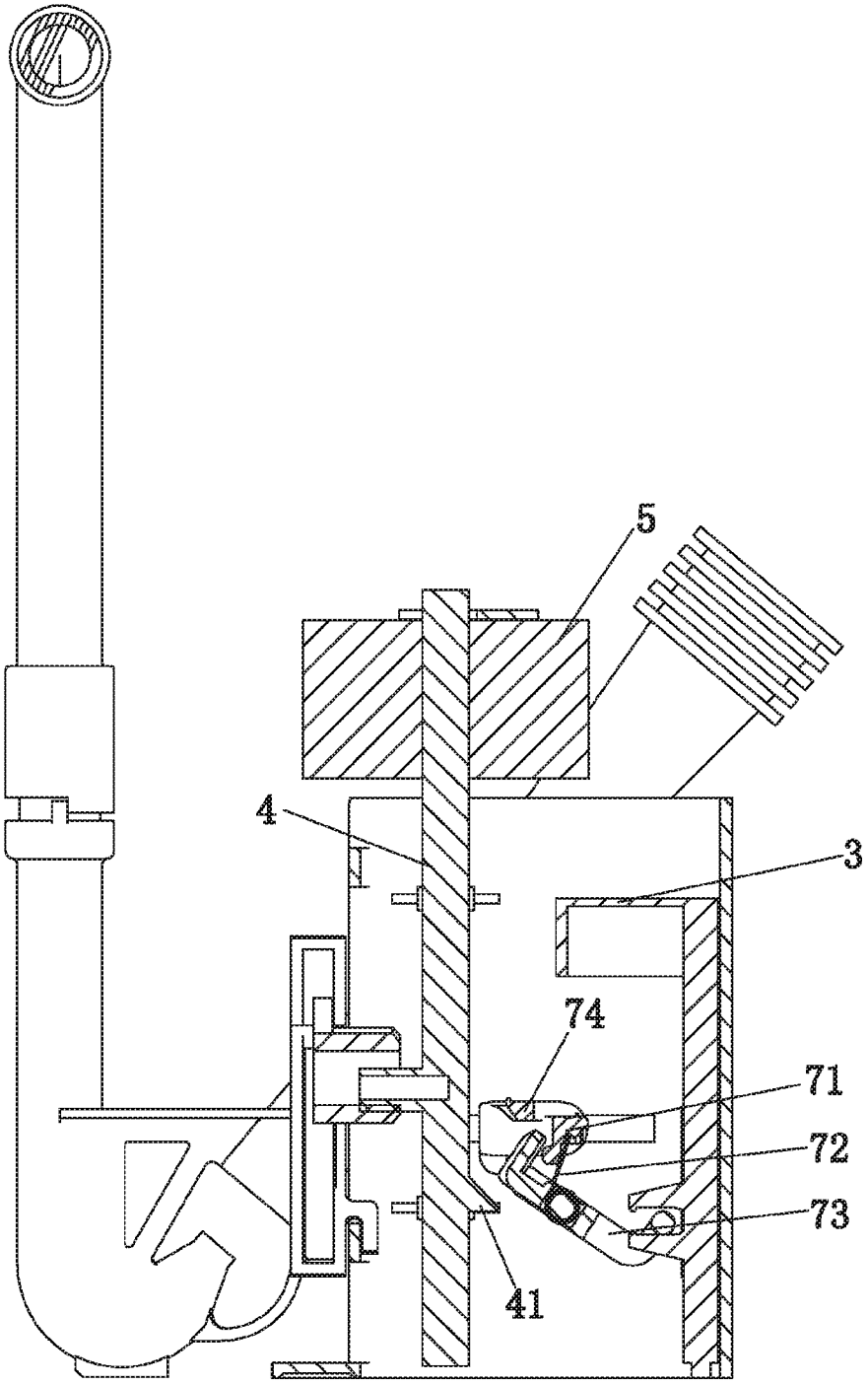
FIG. 11 illustrates a longitudinal sectional diagram of the second embodiment of the present invention when the waterway switch component is in close state.
Figure 12:
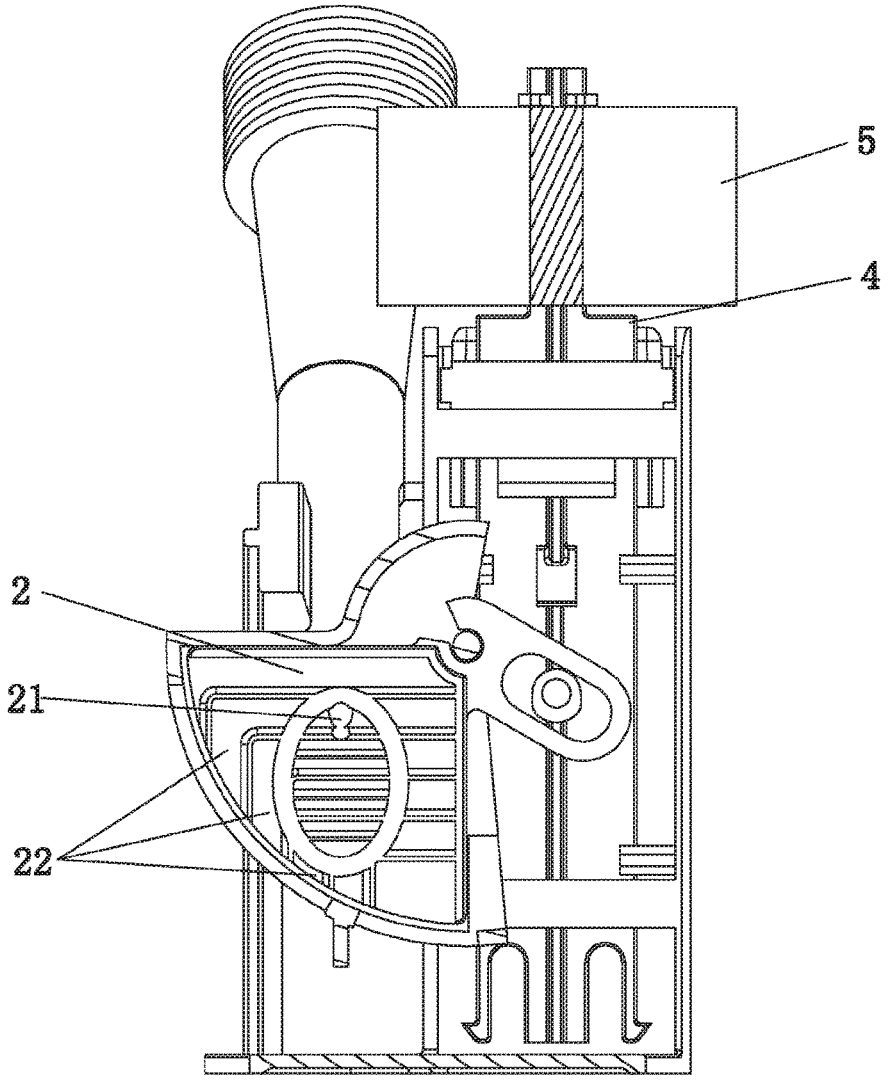
FIG. 12 illustrates a second longitudinal sectional diagram of the second embodiment of the present invention when the waterway switch component is in close state.

The working process of the bowl flushing control device of low tank type toilet of the present invention is that:

Before flushing the toilet bowl, the float bowl 3 and the floater 5 are floating, the water stop plate 2 is open, the hanging portion 74 of the slide block 71 hangs to the protruding portion 41 of the control rod 4, as figured in FIG. 9 and FIG. 10;

When flushing the toilet bowl, the discharge valve works to discharge water in the tank to the spraying passage of the toilet, water level in the tank lowers down and the inlet valve is driven to inlet water; when water flows out of the inlet valve, the flushing water is supplies to the water supply pipe 1, at the same time, water in the tank is absorbed to the water supply pipe 1 through the opening of the working chamber 11 of the water supply pipe 1 and flushes to the flushing ring passage with the flushing water of the inlet valve to flush the bowl of the toilet; after the discharge valve is closed, the water supply pipe 1 continuously supplies water to the toilet. Before the water level in the tank lowers to the working level of the float bowl 3, the float bowl 3 keeps in floating state, the hanging portion 74 of the slide block 71 still hangs to the protruding portion 41 of the control rod 4, the control rod 4 does not fall down, the water stop plate 2 still keeps in open. With the water level in the tank continuously lowers (lower than the working level of the float bowl 3), the float bowl 3 rotates in the clockwise direction, making the driving component 73 rotate in the clockwise direction and push the slide block 71 to move right, making the guiding rod 4 escape from the restriction of the slide block 71 and the torsion spring 72 store energy. During this process, the floater 5 lowers with the lowering of the water level in the tank and drives the water stop plate 2 to rotate in the clockwise direction till the internal waterway of the water supply pipe 1 is closed with the gravity of the control rod 4, as figured in FIG. 11 and FIG. 12. At this time, the inlet valve keeps inlet, most of flushing water is stored in the toilet tank through the guide groove 22 of the water stop plate 2, a small amount of flushing water flows to the flushing ring passage of the toilet to replenish water to the toilet through the water replenishing hole 21 of the water stop plate 2 and the water supply pipe 1.

During the water storing process, water level in the tank gradually raises. When the water level in the tank is higher than the lowest working level of the float bowl 3, the float bowl 3 rotates in the counter-clockwise direction until it completely floats up; with the floating of the float bowl 3, the driving component 73 gradually rotates in the counter clockwise direction, at the same time, the torsion spring 72 stores energy to make the slide block 71 move left to reset. At this time, as the inlet valve still inlets water, it provides a pull force for the water stop plate 2 to rotate in the clockwise direction and indirectly provides a pull force of downward for the control rod 4, and when the water level in the tank submerges the floater 5, the pull force is still larger than the float force of the floater 5, making the water supply pipe 1 keep in close, the tank continuously stores water.

After water storing finishes, the impact force of the inlet water of the inlet valve to the water stop valve 2 disappears, the float force on the floater 5 is larger than the gravity of the floater 5 and the control rod 4, the floater 5 drives the control rod 4 to float up and pulls the water stop plate 2 to rotate in the counter clockwise direction to completely open for next time's discharge. During the control rod 4 floats up, the guide incline surface of the protruding portion 41 contacts the guide incline surface of the hanging portion 74 of the slide block 71 and continuously floats up with the control rod 4, the guide incline surface of the protruding portion 41 pushes the slide block 71 to slide right to give space, making the protruding portion 41 move up and pass the hanging portion 74 of the slide block 71 and finally hook to the hanging portion 74 of the slide block 71, thus resetting to the initial state before flushing, as figured in FIG. 7 and FIG. 8.

The Third Embodiment

Figure 13:
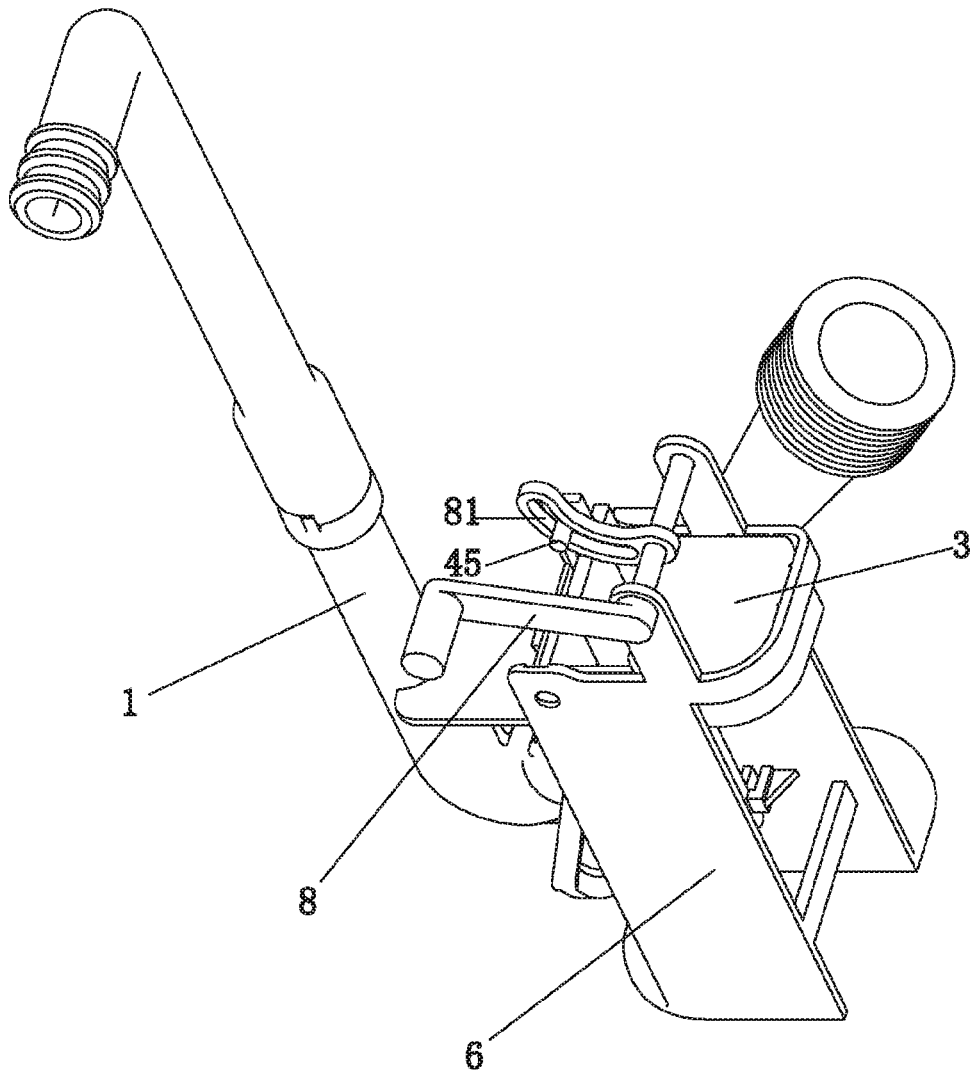
FIG. 13 illustrates a schematic diagram of a third embodiment of the present invention.
Figure 14:
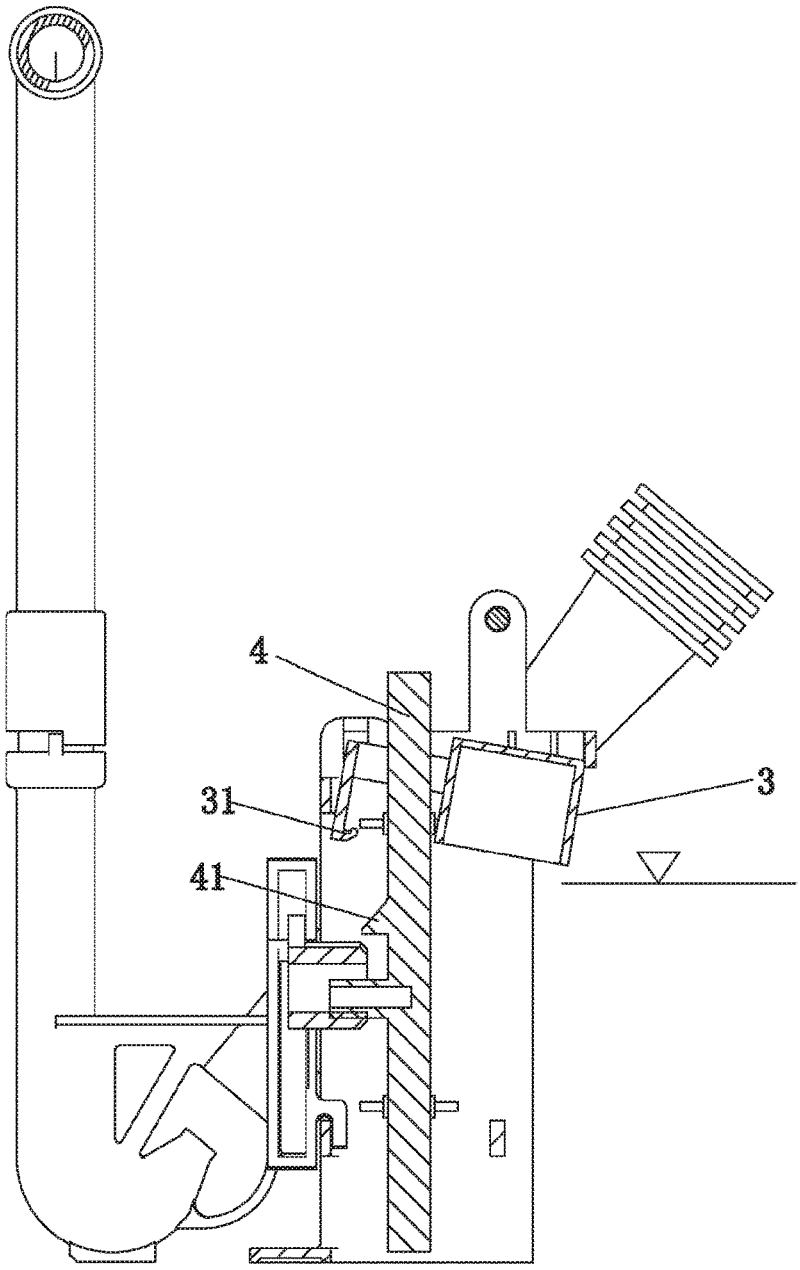
FIG. 14 illustrates a longitudinal sectional diagram of the third embodiment of the first embodiment when the first floater rotates.
Figure 15:
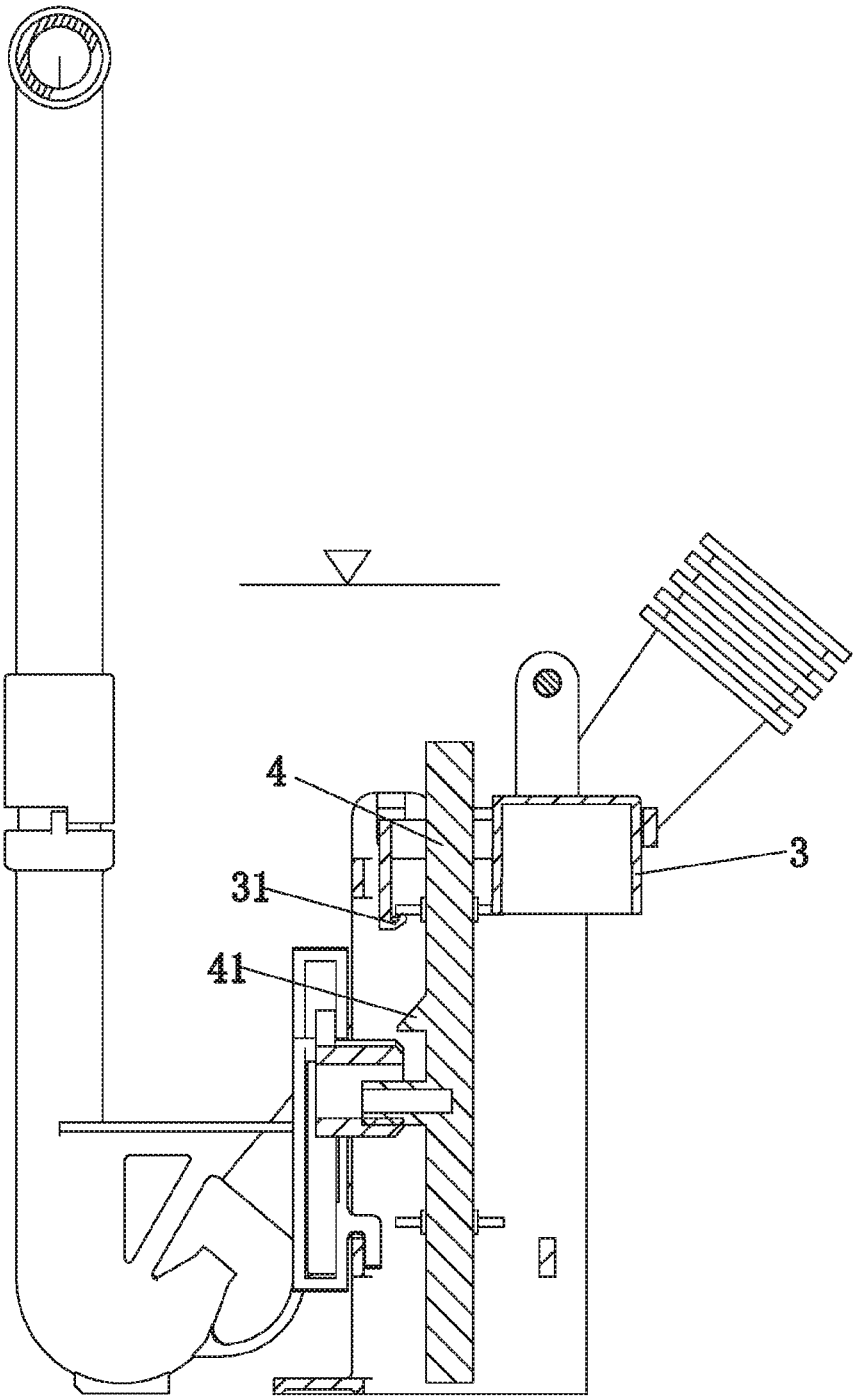
FIG. 15 illustrates a longitudinal sectional diagram of the third embodiment of the first embodiment when the first floater is reset.

Referring to FIGS. 13-15, this embodiment differs from the first embodiment in that: The activation component is a pull rod 8 linked to the discharging operation mechanism of the toilet, the pull rod 8 is synchronously coupled to the control rod 4. In detail, the pull rod 8 is rotatably connected to the top portion of the rack 6, the pull rod 8 is disposed with a second connecting portion at the radial direction of the rotating shaft; the second connecting portion is disposed with a second elongate hole 81, the side surface of the top portion of the control rod 4 is disposed with a pin shaft 45, the pin shaft 45 is slidably inserted to the second elongate hole 81.

When the water level in the tank is lower than the working level of the float bowl 3, the float bowl 3 rotates in the clockwise direction to make the hook 31 separate from the protruding portion 41 of the control rod 4, the control rod 4 moves downwardly by the gravity and drives the water stop plate 2 to rotate clockwisely to close the internal waterway of the water supply pipe 1, as figured in FIG. 14.

When the water level in the tank rises until to be higher than the working level of the float bowl 3, the float bowl 3 floats up. As the material proportion of the control rod 4 and the water stop plate 2 is larger than water, the control rod 4 is still in the lowest level, the water stop plate 2 keeps in closing the water supply pipe, as figured in FIG. 15.

The Fourth Embodiment

Figure 16:
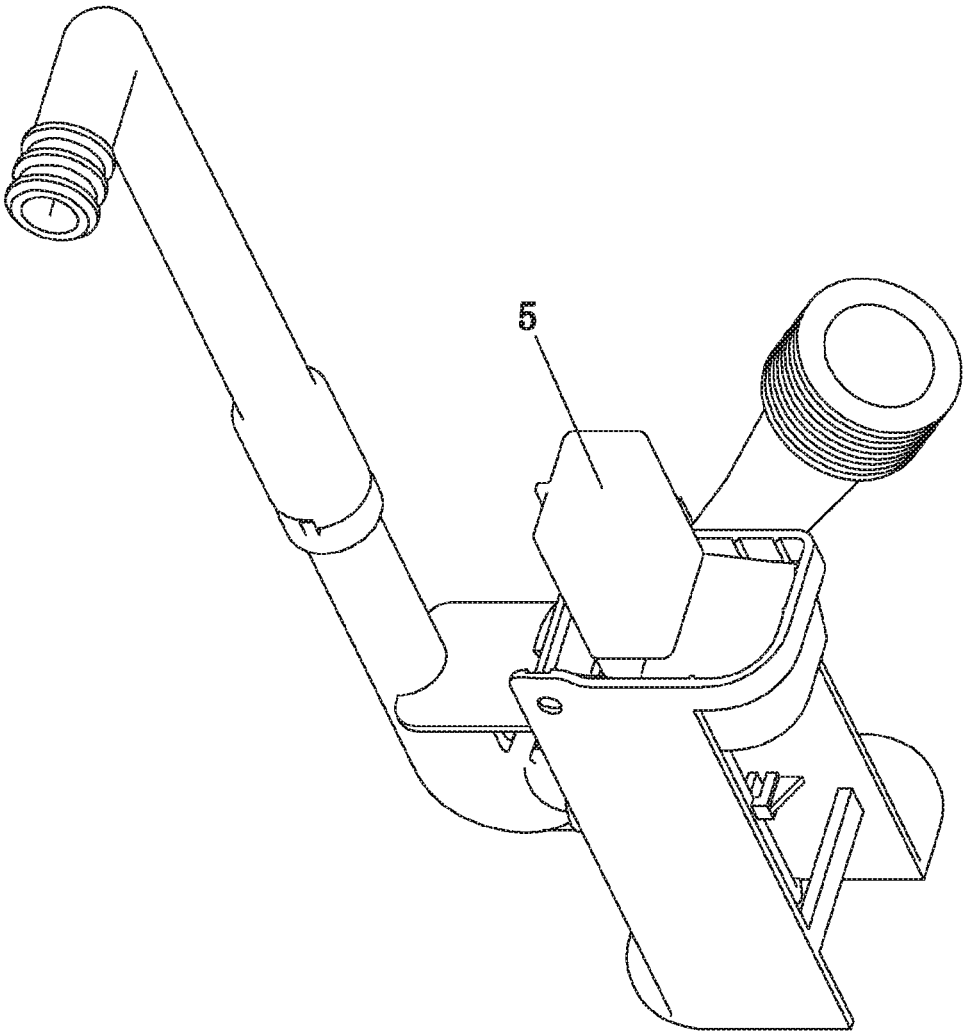
FIG. 16 illustrates a schematic diagram of a fourth embodiment of the present invention.
Figure 17:
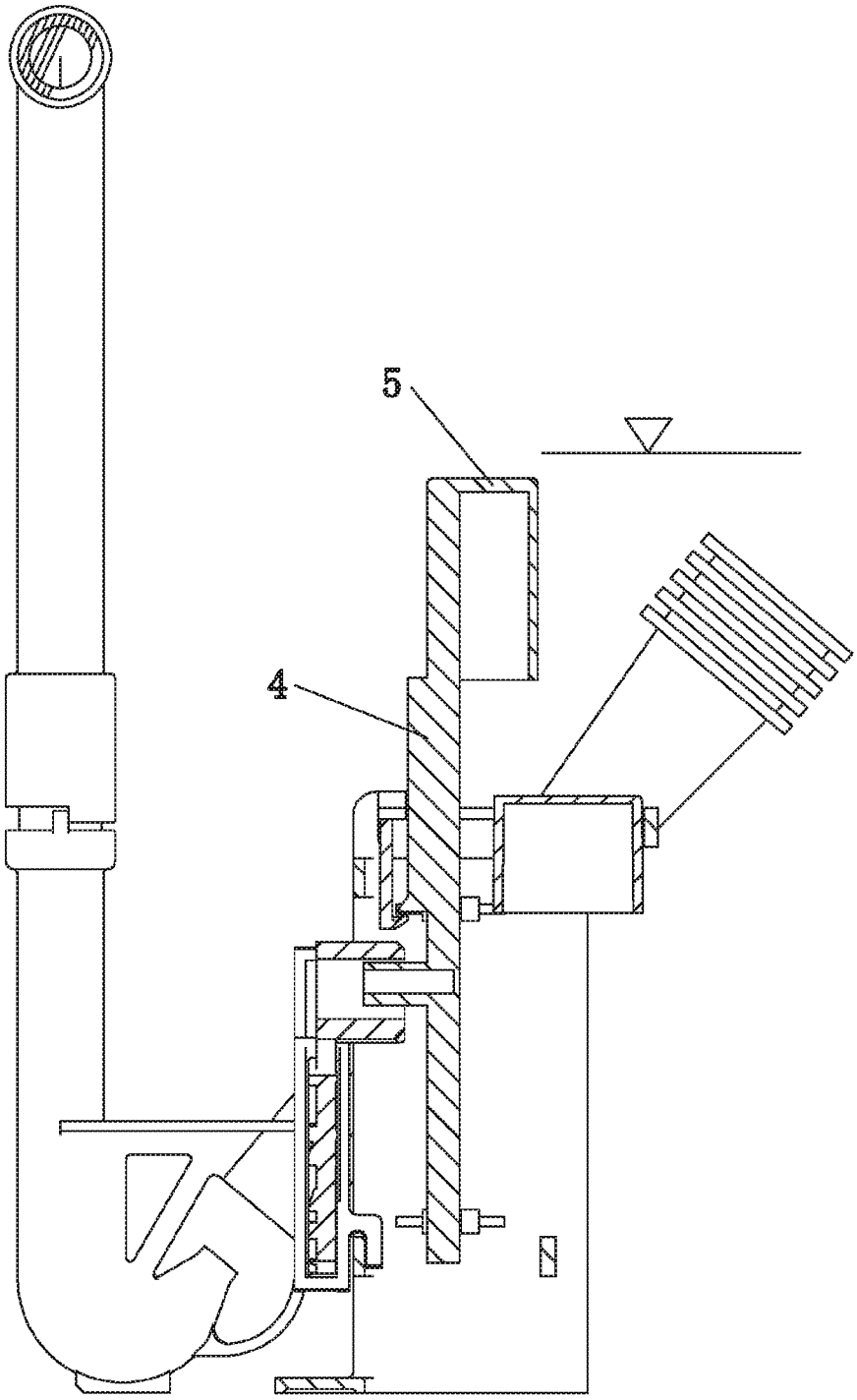
FIG. 17 illustrates a longitudinal sectional diagram of the fourth embodiment of the present invention.

As figured in FIG. 16 and FIG. 17, this embodiment differs from the first embodiment in that: the floater 5 is once formed to the top portion of the control rod 4. The rest structure and the working process of this embodiment are similar to the first embodiment.

The Fifth Embodiment

Figure 18:
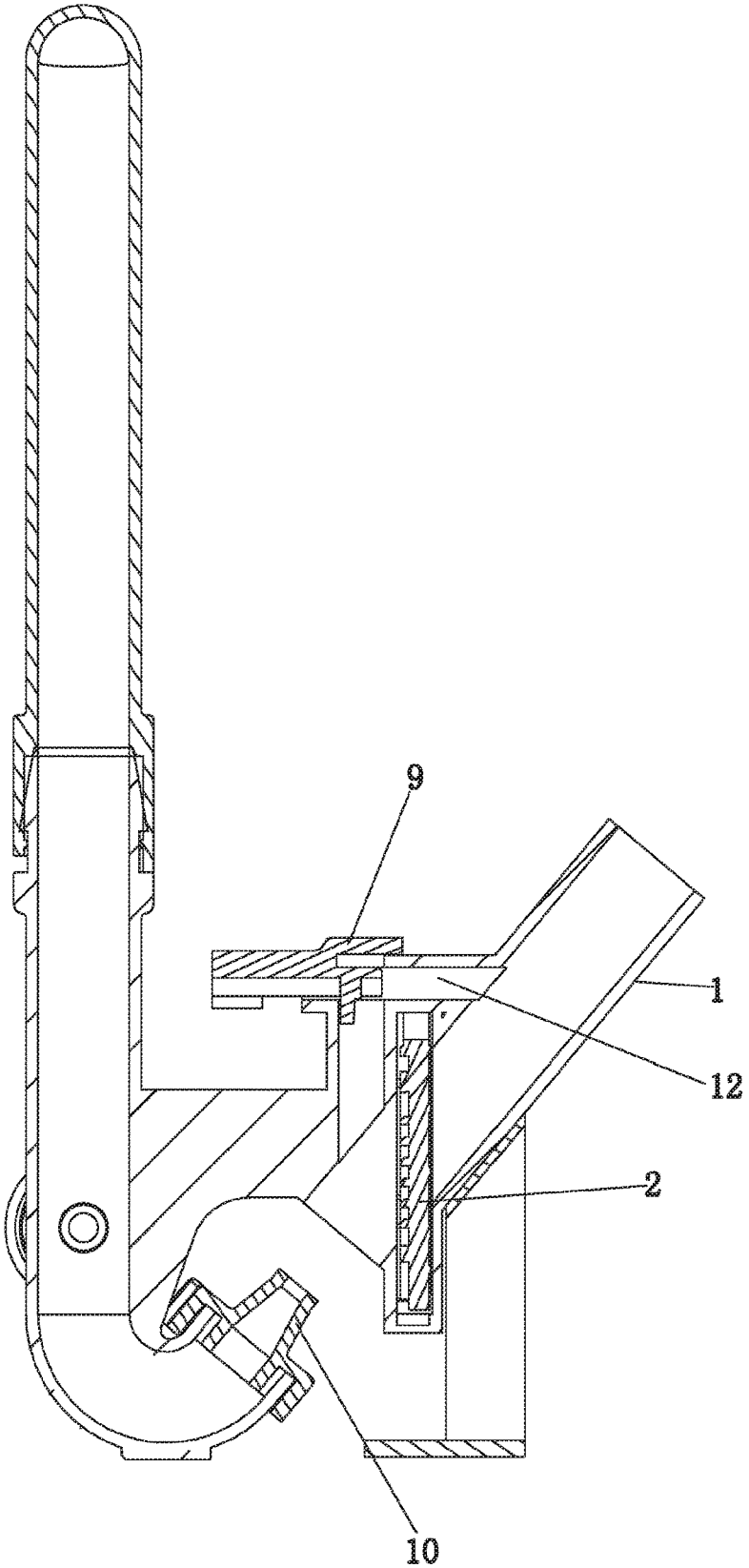
FIG. 18 illustrates a longitudinal sectional diagram of a fifth embodiment of the present invention.
Figure 19:
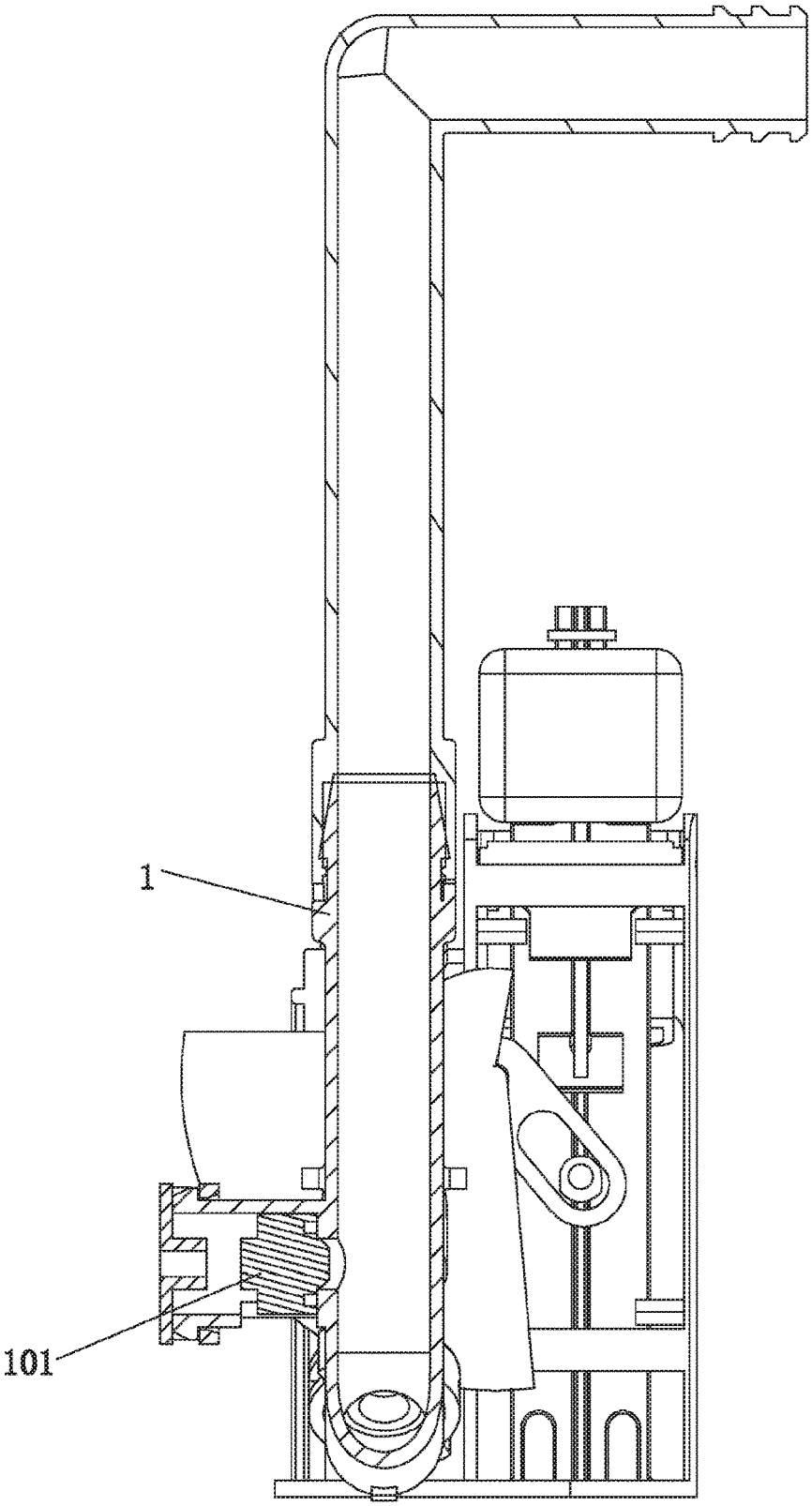
FIG. 19 illustrates a second longitudinal sectional diagram of the fifth embodiment of the present invention.
Figure 20:
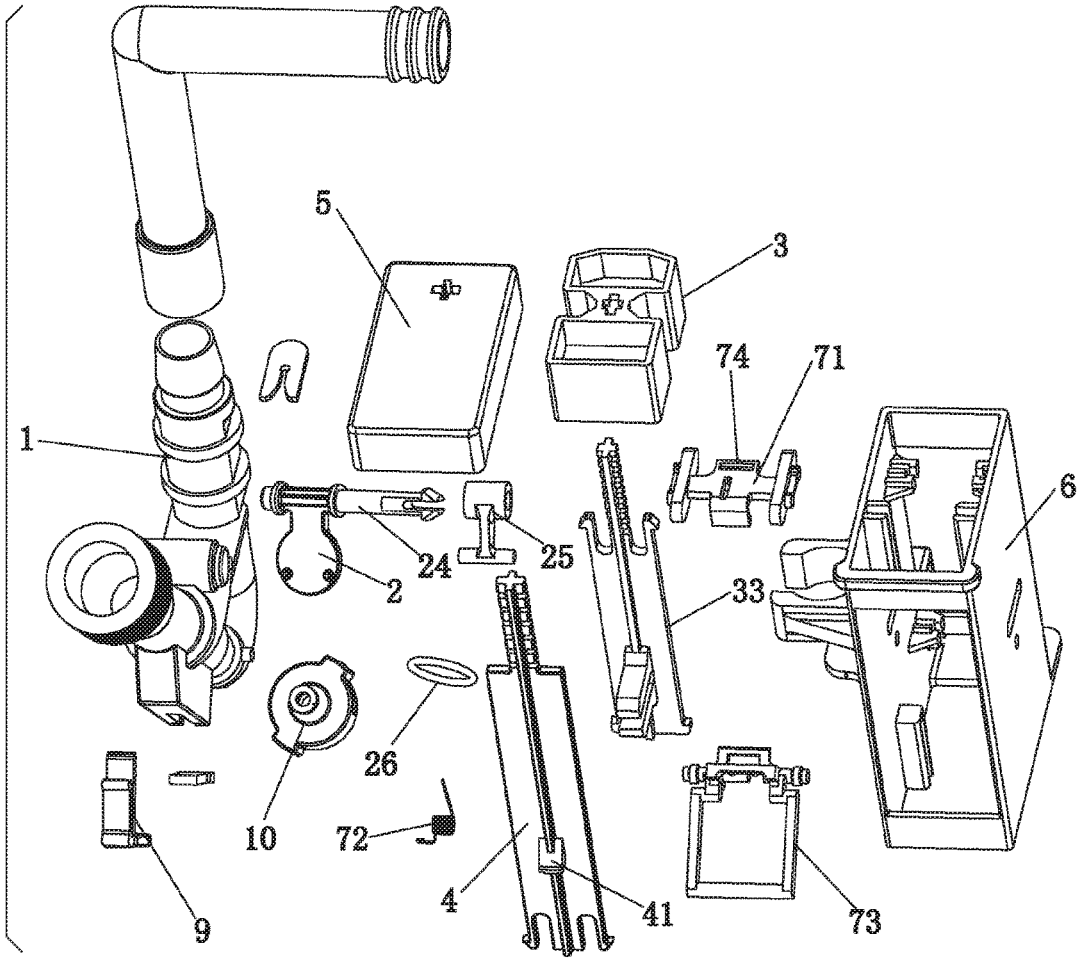
FIG. 20 illustrates an exploded diagram of a sixth embodiment of the present invention.
Figure 21:
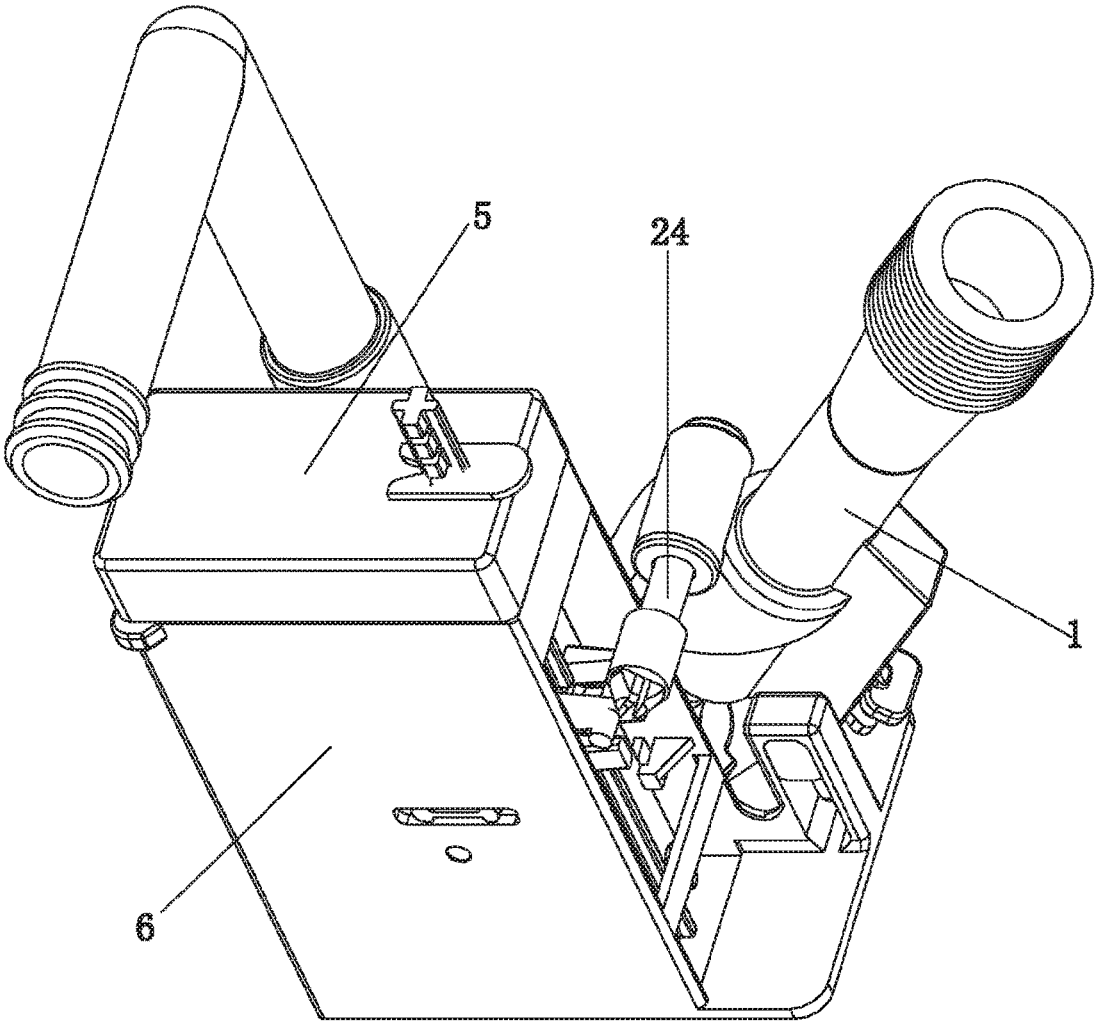
FIG. 21 illustrates a schematic diagram of the sixth embodiment of the present invention.

As figured in FIG. 18 and FIG. 19, this embodiment differs from the first embodiment mainly in that: the water replenishing structure comprises two water replenishing passages 12; this embodiment further comprises a water replenishing adjusting piece 9, two water replenishing passages 12 are once formed in the water supply pipe 1, one end of each water replenishing passage 12 is respectively connected to the corresponding waterway of the two waterways at two sides of the working chamber 11 of the water supply pipe 1; the other end of each water replenishing passage 12 are connected, where the water replenishing adjusting piece 9 is assembled. Two water replenishing passages 12 are respectively arranged laterally and longitudinally; the water replenishing adjusting piece 9 can move laterally to adjust the section of the water replenishing passage 12 so as to adjust the water replenishing volume, making the applicability of the present invention better for various of toilets with different water replenishing volume.

In this embodiment, the waterway of the water supply pipe 1 corresponding to the front side of the working chamber 11 is disposed with a removable spraying nozzle 10, which is used to adjust the flow rate to improve the flushing effect.

In this embodiment, the waterway of the water supply pipe 1 corresponding to the front side of the working chamber 11 is disposed with a relief valve 101. In detail, the relief valve 101 is assembled to the side surface of the water supply pipe 1 correspondingly. When the inlet pressure fluctuates greatly, the relief valve 101 can stabilize the pressure through the water stop plate 2, thus guaranteeing the stable flow rate and providing better flushing effect.

The Sixth Embodiment

As figured in FIGS. 20-27, this embodiment differs from the first embodiment in that: the axis of the water stop plate 2 is vertical to a rotating shaft 24 disposed at one end of the water stop plate 2. the rotating axis 24 is movably connected to the control rod 4 by a connecting element 25. The water stop plate 2 is further disposed with a sealing ring 26; when the water stop plate 2 closes the internal waterway of the water supply pipe 1, the sealing ring 26 abuts between the water stop plate 2 and the internal wall of the water supply pipe 1 to provide efficient sealing to the gap therebetween.

In this embodiment, the float bowl 3 is movably assembled to the rack 6 up and down, and it moves down when the water level in the toilet tank is lower than the working level; a transmission mechanism 7 is further provided, the float bowl 3 is linked to the control rod 4 by the transmission mechanism. The float bowl 3 is fixed to a guide rod 33; one end of the driving component 73 is rotatably connected to the guide rod 3, the other end is movably connected to the slide block 71 to push the slide block 71 to slide when the float bowl 3 moves downwardly so as to make the hanging portion 74 of the slide block 71 escape from the protruding portion 41; the slide block 71 is reset by the elastic element, which is a torsion spring 72 assembled to the rotating shaft of the driving component 73; two ends of the torsion spring 72 abuts between the driving component 73 and the slide block 71.

the water replenishing structure comprises two water replenishing passages 12; this embodiment further comprises a water replenishing adjusting piece 9, two water replenishing passages 12 are once formed in the water supply pipe 1, one end of each water replenishing passage 12 is respectively connected to the corresponding waterway of the two waterways at two sides of the working chamber 11 of the water supply pipe 1; the other end of each water replenishing passage 12 are connected, where the water replenishing adjusting piece 9 is assembled. Two water replenishing passages 12 are respectively arranged laterally and longitudinally; the water replenishing adjusting piece 9 can move laterally to adjust the section of the water replenishing passage 12 so as to adjust the water replenishing volume, making the applicability of the present invention better for various of toilets with different water replenishing volume.

In this embodiment, the waterway of the water supply pipe 1 corresponding to the front side of the working chamber 11 is disposed with a removable spraying nozzle 10, which is used to adjust the flow rate to improve the flushing effect.

Figure 22:
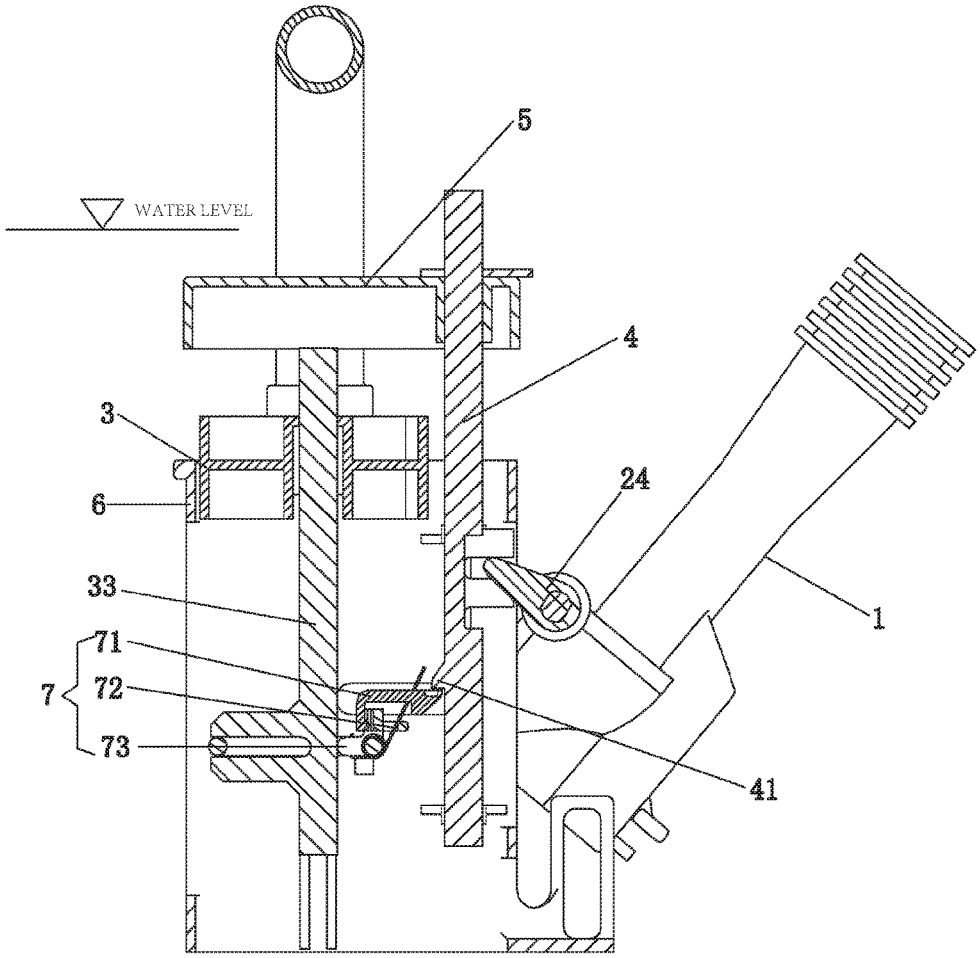
FIG. 22 illustrates a sectional diagram of the sixth embodiment of the present invention before water flushes out.
Figure 23:
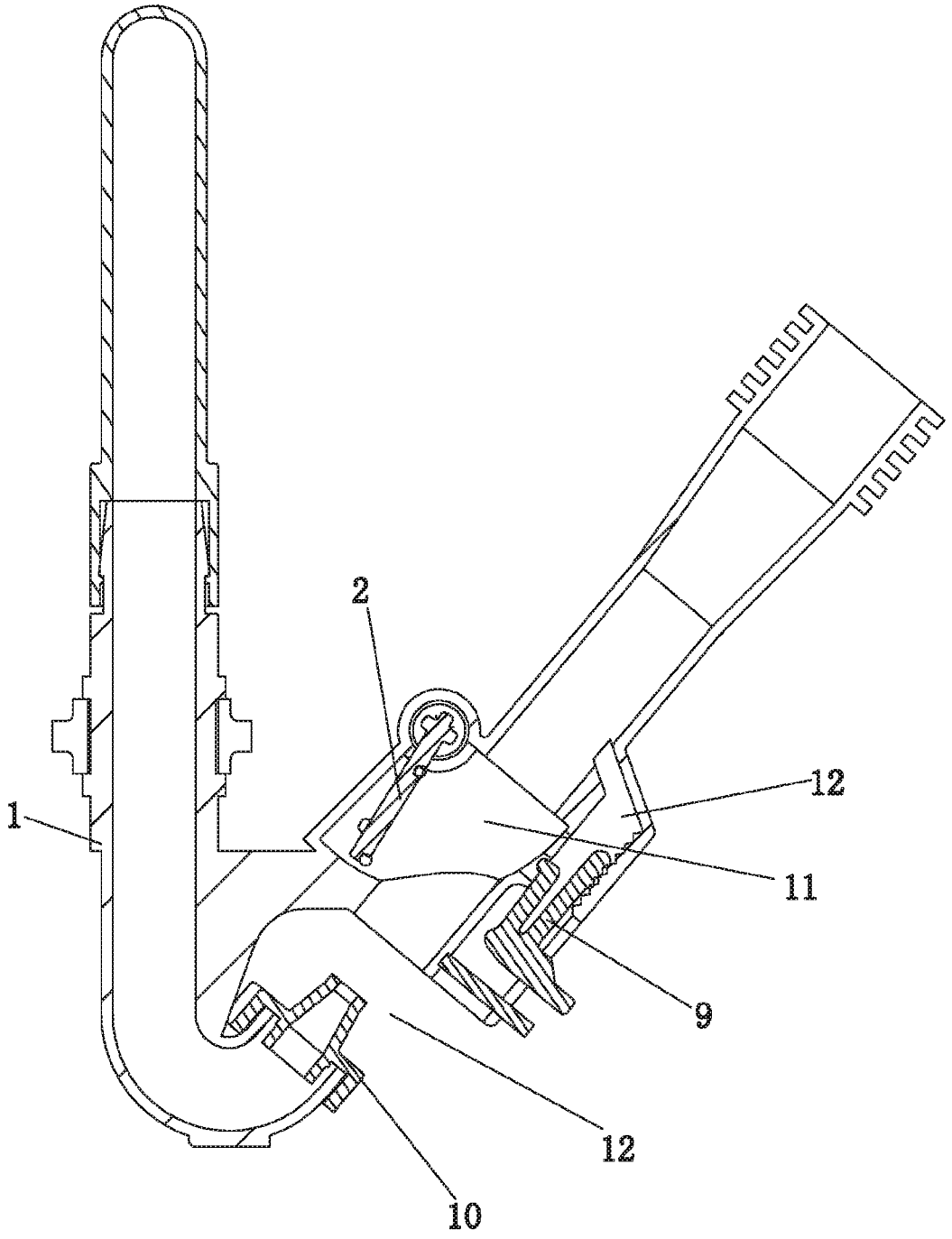
FIG. 23 illustrates a second sectional diagram of the sixth embodiment of the present invention before water flushes out.

Before flushing, this embodiment is as figured in FIG. 22 and FIG. 23. at this time, the float bowl 3 and the floater 5 are floating, the water stop plate 2 is open, the hanging portion 74 of the slide block 71 hangs to the protruding portion 41 of the control rod 4.

Figure 24:
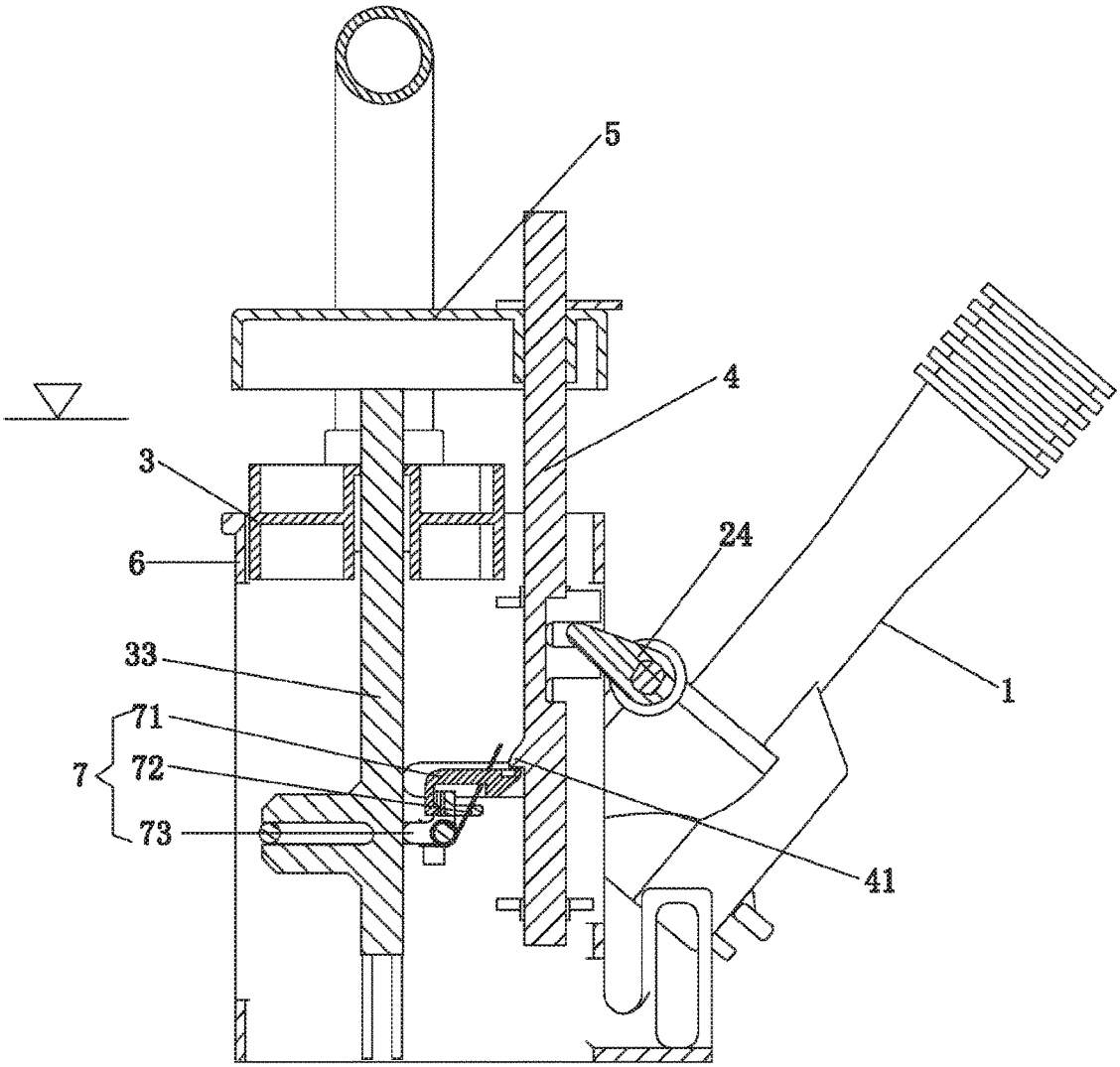
FIG. 24 illustrates a sectional diagram of the sixth embodiment of the present invention during the water is flushing.
Figure 25:
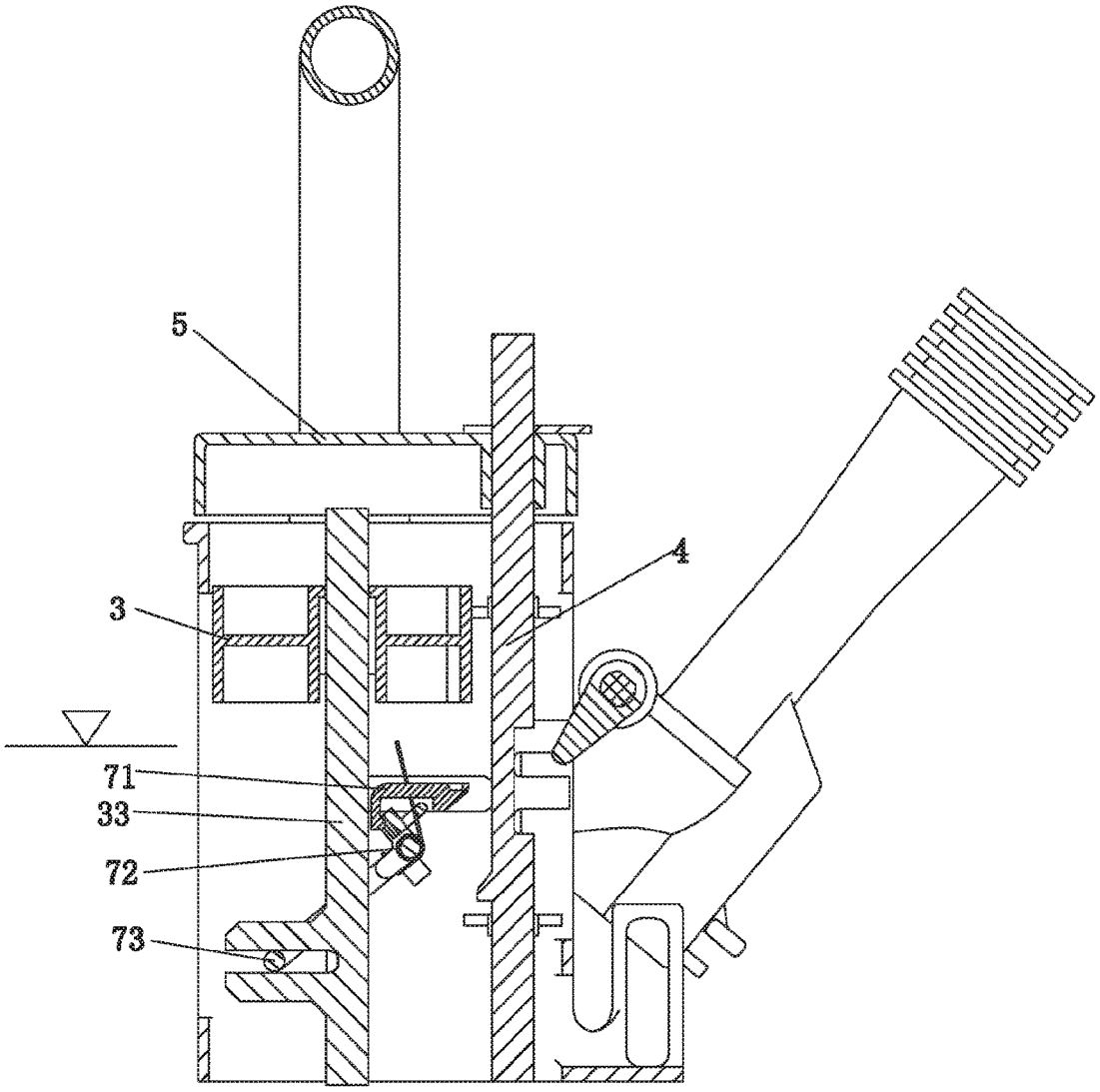
FIG. 25 illustrates a sectional diagram of the sixth embodiment of the present invention during the water is being stored.
Figure 26:
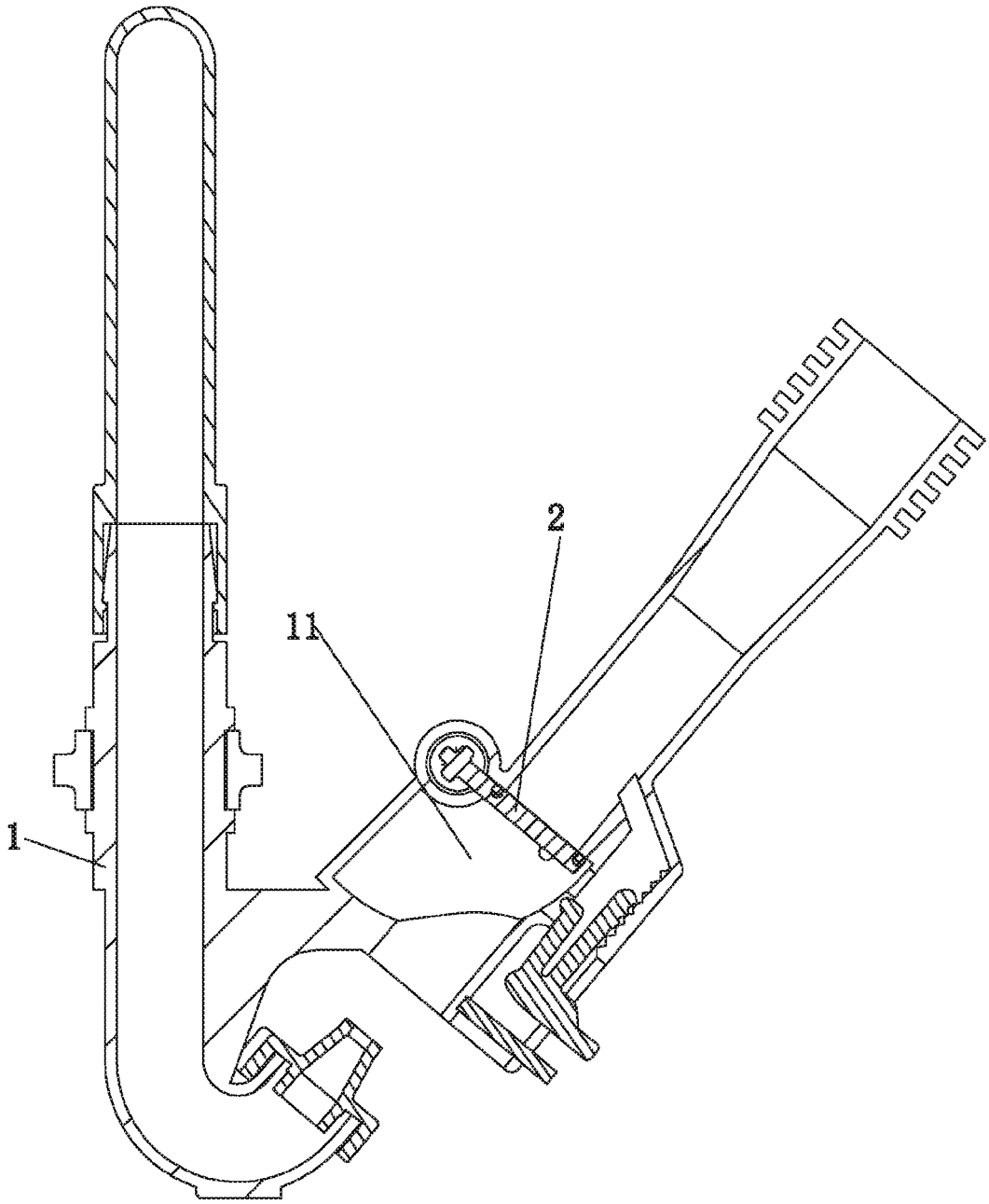
FIG. 26 illustrates a second sectional diagram of the sixth embodiment of the present invention during the water is being stored.
Figure 27:
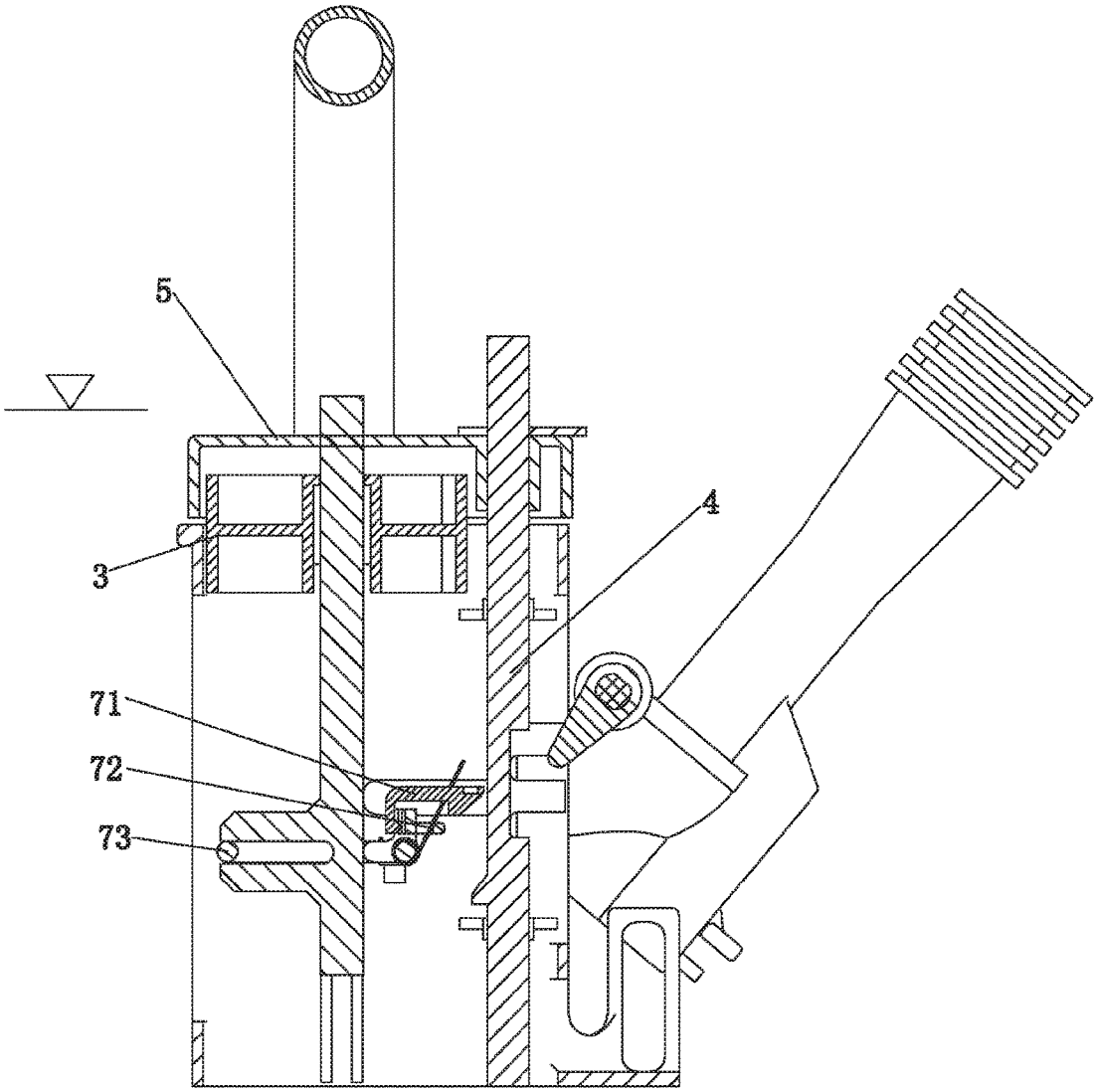
FIG. 27 illustrates a third sectional diagram of the sixth embodiment of the present invention during the water is being stored.

When flushing the toilet bowl, the discharge valve works to discharge water in the tank to the spraying passage of the toilet, water level in the tank lowers down, as figured in FIG. 24, and the inlet valve is driven to inlet water; when water flows out of the inlet valve, the flushing water is supplies to the water supply pipe 1, at the same time, water in the tank is absorbed to the water supply pipe 1 through the connecting opening 12 of the water supply pipe 1 and flushes to the flushing ring passage with the flushing water of the inlet valve to flush the bowl of the toilet; after the discharge valve is closed, the water supply pipe 1 continuously supplies water to the toilet. Before the water level in the tank lowers to the working level of the float bowl 3, the float bowl 3 keeps in floating state, the hanging portion 74 of the slide block 71 still hangs to the protruding portion 41 of the control rod 4, the control rod 4 does not fall down, the water stop plate 2 still keeps in open. With the water level in the tank continuously lowers (lower than the working level of the float bowl 3), the float bowl 3 rotates in the clockwise direction, making the driving component 73 rotate in the counter clockwise direction (as figured in FIG. 24) and push the slide block 71 to move horizontally in the direction away from the control rod, making the guiding rod 4 escape from the restriction of the slide block 71 and the torsion spring 72 store energy, as figured in FIG. 25. During this process, the floater 5 lowers with the lowering of the water level in the tank and drives the water stop plate 2 to rotate in the counter clockwise direction till the internal waterway of the water supply pipe 1 is closed with the gravity of the control rod 4, as figured in FIG. 26. At this time, the inlet valve keeps inlet, most of flushing water is stored in the toilet tank through the connecting opening 12 of the water supply pipe 1, a small amount of flushing water flows to the flushing ring passage of the toilet through the water replenishing passage 12 to replenish water to the toilet.

During the water storing process, water level in the tank gradually raises. When the water level in the tank is higher than the lowest working level of the float bowl 3, the float bowl 3 floats up until it completely floats up; with the floating of the float bowl 3, the driving component 73 gradually rotates in the clockwise direction, at the same time, the torsion spring 72 stores energy to make the slide block 71 slide horizontally in the direction closing to the control rod to reset, as figured in FIG. 27. At this time, as the inlet valve still inlets water, it provides a push force for the water stop plate 2 to rotate in the counter clockwise direction and indirectly provides a pull force of downward for the control rod 4, and when the water level in the tank submerges the floater 5, the pull force is still larger than the float force of the floater 5, making the water supply pipe 1 keep in close, the tank continuously stores water.

After water storing finishes, the impact force of the inlet water of the inlet valve to the water stop valve 2 disappears, the float force on the floater 5 is larger than the gravity of the floater 5 and the control rod 4, the floater 5 drives the control rod 4 to float up and pulls the water stop plate 2 to rotate in the clockwise direction to completely open for next time's discharge. During the control rod 4 floats up, the guide incline surface of the protruding portion 41 contacts the guide incline surface of the hanging portion 74 of the slide block 71 and continuously floats up with the control rod 4, the guide incline surface of the protruding portion 41 pushes the slide block 71 to slide right to give space for the protruding portion 41 to move up and pass the hanging portion 74 of the slide block 71 and finally hook to the hanging portion 74 of the slide block 71, thus resetting to the initial state before flushing.

The Seventh Embodiment

Figure 28:
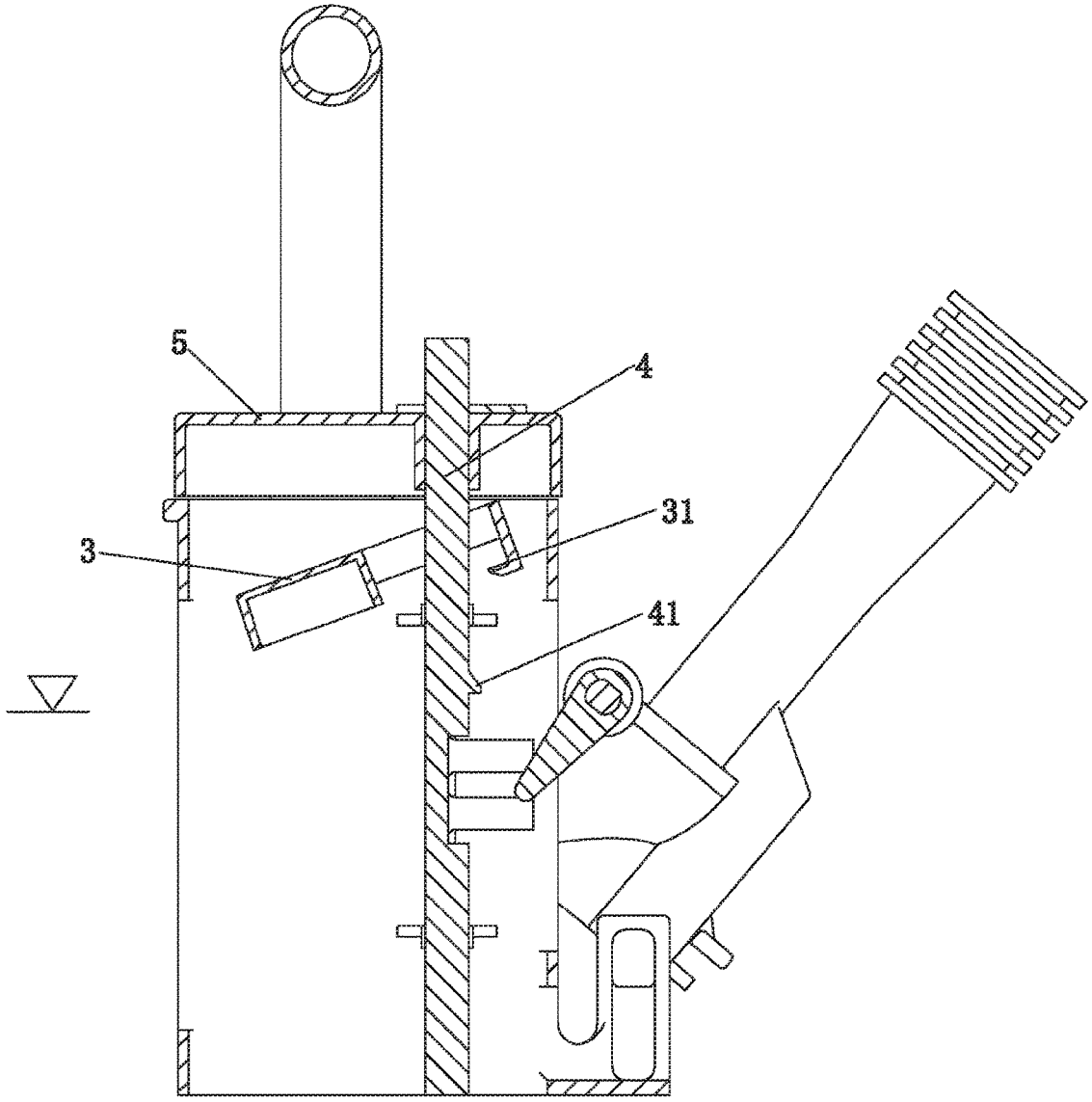
FIG. 28 illustrates a sectional diagram of a seventh embodiment of the present invention during the water is being stored.
Figure 29:
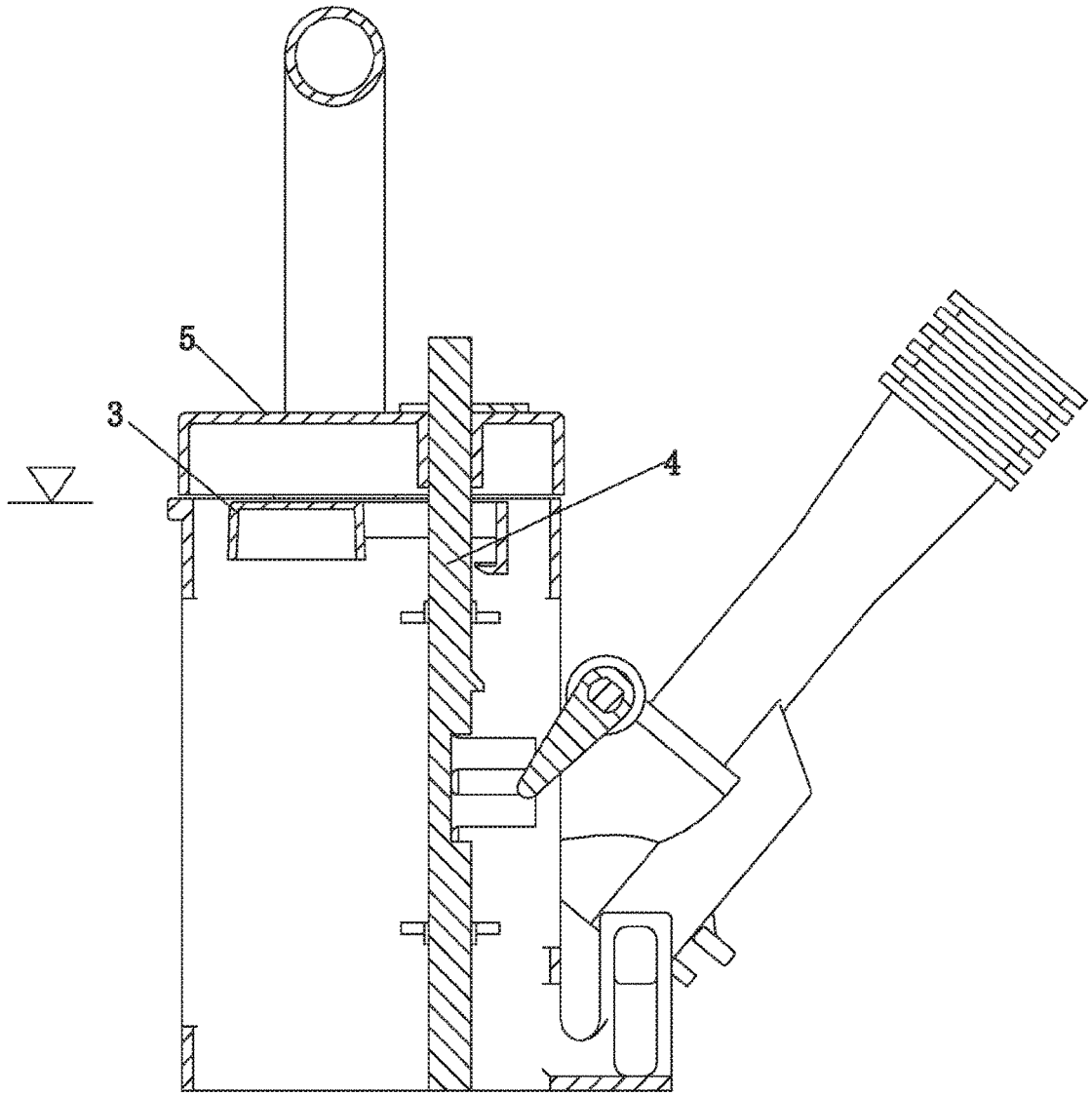
FIG. 29 illustrates a second sectional diagram of the seventh embodiment of the present invention during the water is being stored.
Figure 30:
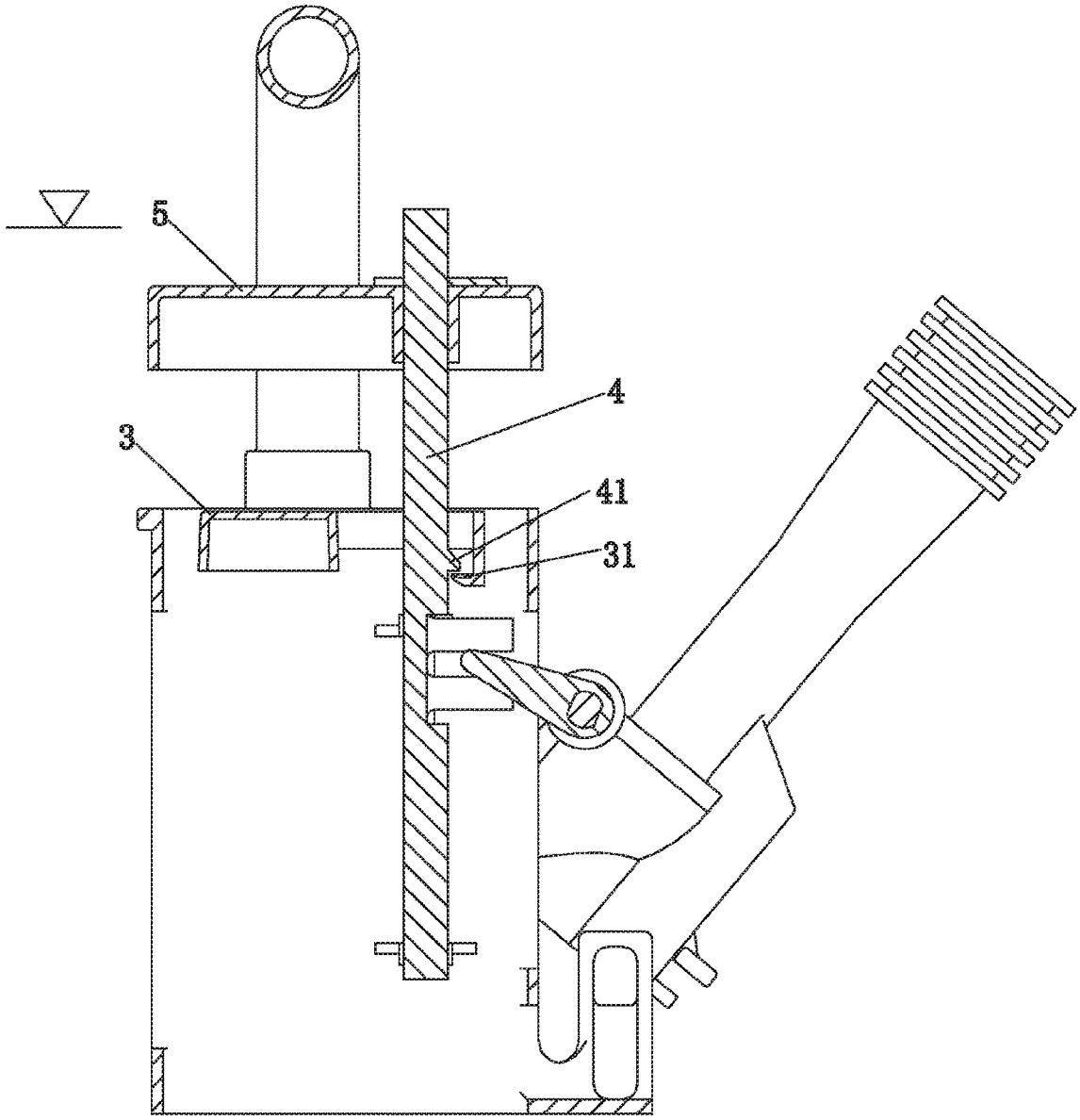
FIG. 30 illustrates a sectional diagram of the seventh embodiment of the present invention after water is stored.
Figure 31:
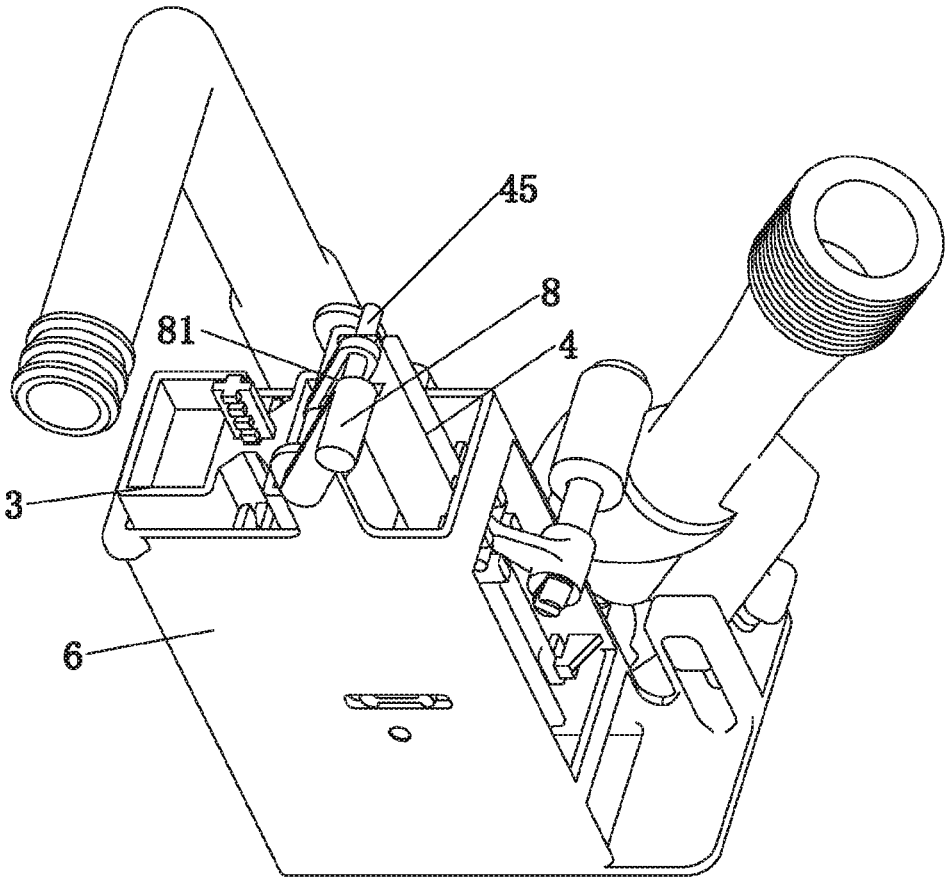
FIG. 31 illustrates a schematic diagram of an eighth embodiment of the present invention.
Figure 32:
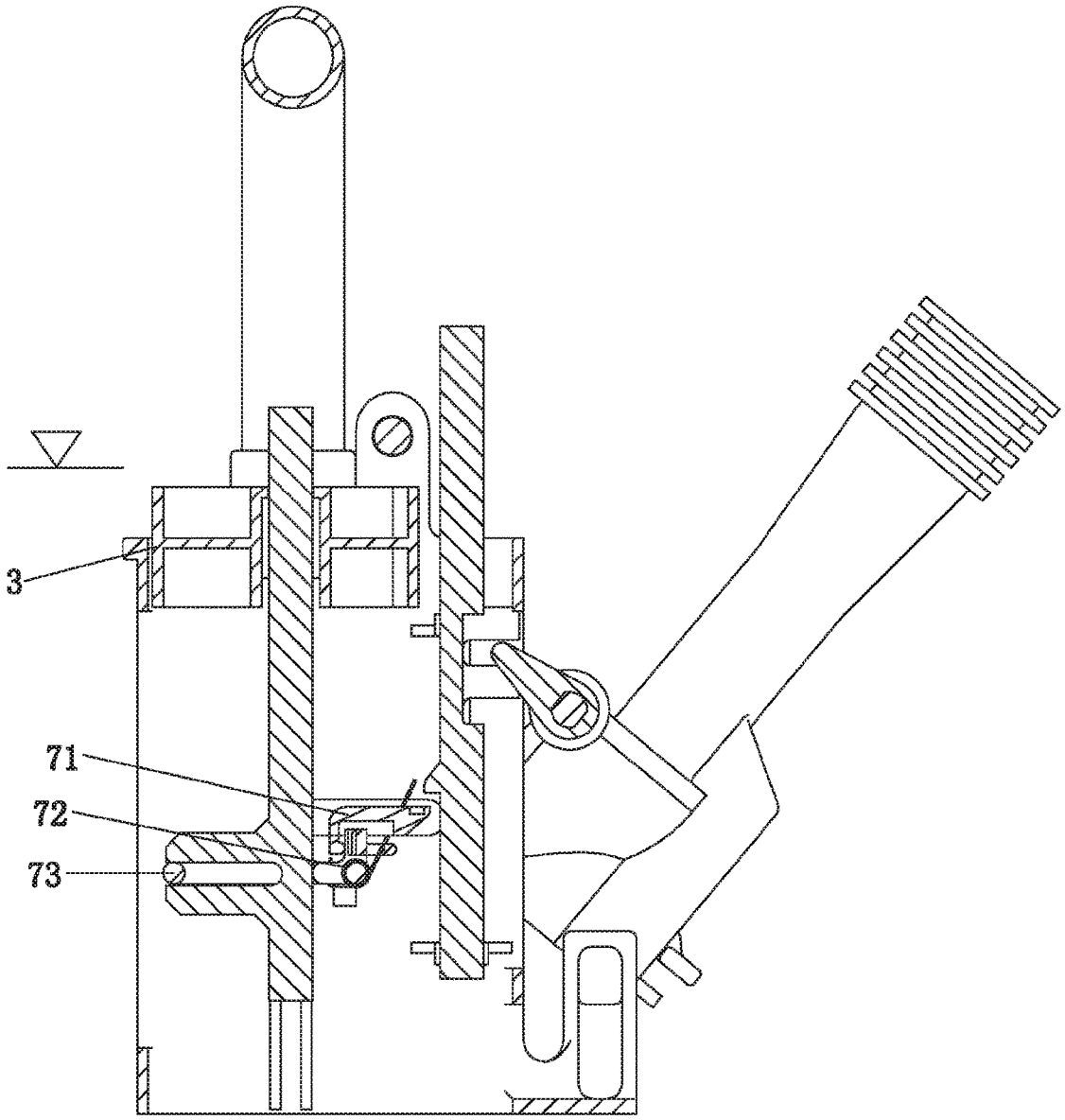
FIG. 32 illustrates a sectional diagram of the eighth embodiment of the present invention in discharging state.
Figure 33:
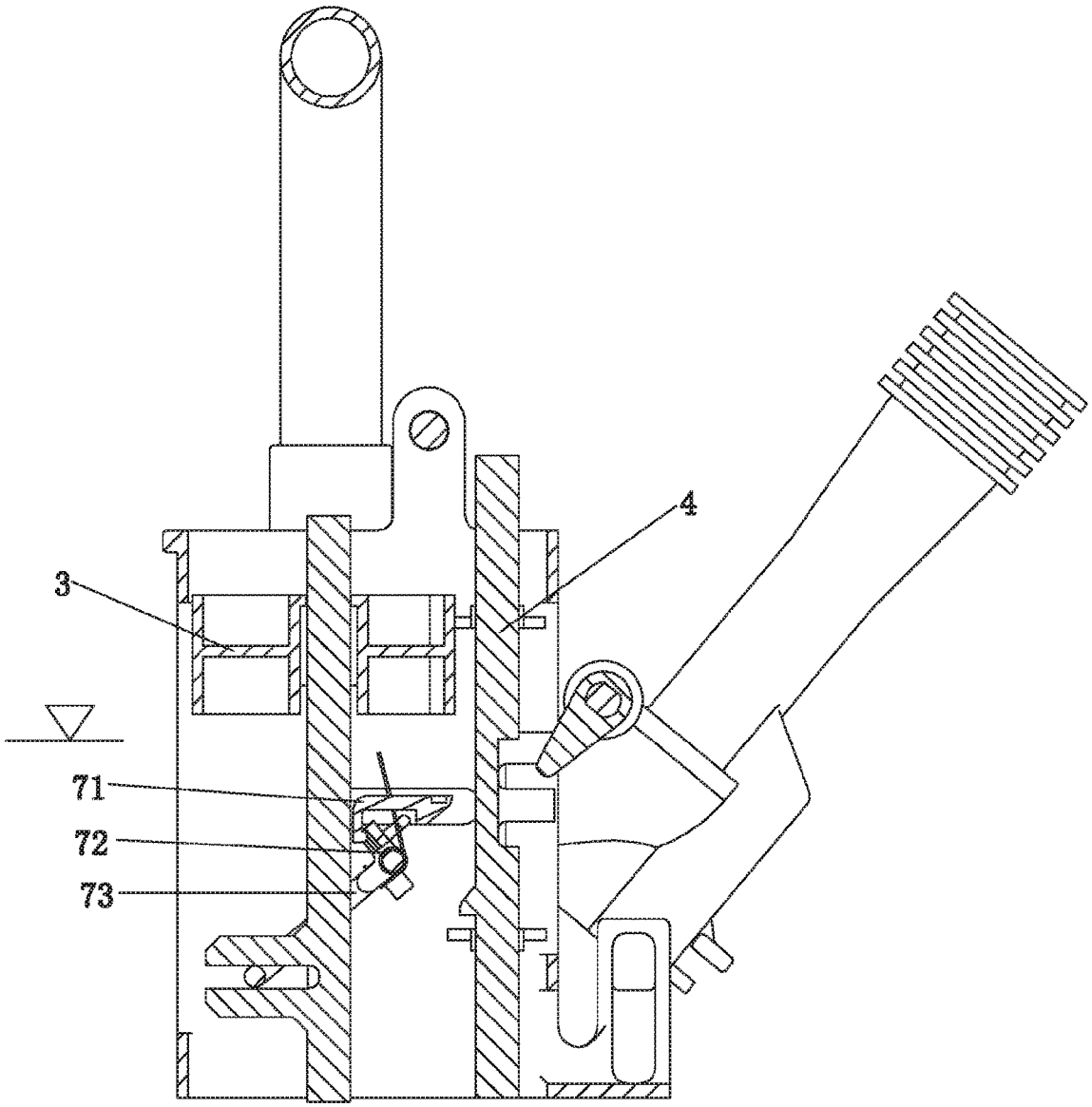
FIG. 33 illustrates a sectional diagram of the eighth embodiment of the present invention in water storing state.

As figured in FIGS. 28-30, this embodiment differs from the sixth embodiment in that: the float bowl 3 is rotatably connected to the rack 6, and rotates when the water level in the toilet tank is lower than the working level. The side surface of the control rod 4 is disposed with a protruding portion 41, the external side surface of the protruding portion 41 is disposed with a guide incline surface faced up, the float bowl 3 is correspondingly disposed with a hook 31 hook to the protruding portion 41, the hook 31 is hook to the protruding portion 41 before the float bowl 3 rotates so as to restrict the control rod 4 from moving downwardly.

As figured in FIG. 29, during the water storing process, water level in the tank gradually raises. When the water level in the tank is higher than the lowest working level of the float bowl 3, the float bowl 3 rotates in the reverse direction until it completely floats up. At this time, as the inlet valve still inlets water, it provides a push force for the water stop plate 2 to restrict the water stop plate 2 from rotating and indirectly provides a pull force of downward for the control rod 4, and when the water level in the tank submerges the floater 5, the pull force is still larger than the float force of the floater 5, making the water supply pipe 1 keep in close, the tank continuously stores water.

As figured in FIG. 30, after water storing finishes, the impact force of the inlet water of the inlet valve to the water stop valve 2 disappears, the float force on the floater 5 is larger than the gravity of the floater 5 and the control rod 4, the floater 5 drives the control rod 4 to float up and pulls the water stop plate 2 to rotate till completely open for next time's discharge. During the control rod 4 floats up, the guide incline surface of the protruding portion 41 contacts the guide incline surface of the hook 31 of the float bowl 3 and continuously floats up with the control rod 4, the guide incline surface of the protruding portion 41 pushes the slide block 71 to swing in a small amount, making the protruding portion 41 move up and pass the hook 31 of the float bowl 3 and finally hook to the hook 31 of the float bowl 3, thus resetting to the initial state before flushing.

The Eighth Embodiment

As figured in FIGS. 31-34, this embodiment differs from the sixth embodiment in that: the activation component is a pull rod 8 linked to the discharging operation mechanism of the toilet, the pull rod 8 is connected to the control rod 4. In detail, the pull rod 8 is rotatably connected to the top portion of the rack 6, the pull rod 8 is disposed with a second connecting portion at the radial direction of the rotating shaft; the second connecting portion is disposed with a second elongate hole 81, the side surface of the top portion of the control rod 4 is disposed with a pin shaft 45, the pin shaft 45 is slidably inserted to the second elongate hole 81.

Before water discharging, the water level in the tank is higher than the working level of the float bowl 3, the float bowl 3 floats up. As the material proportion of the control rod 4 and the water stop plate 2 is larger than water, the control rod 4 is still in the lowest level, the water stop plate 2 keeps in closing the water supply pipe, When discharging works, the pull rod 8 is driven to drive the control rod 4 to move upwardly so as to drive the water stop plate 2 to rotate to open the internal waterway of the water supply pipe 1, the protruding portion 41 of the control rod 4 is hanging to the hook 31 of the float bowl 3, as figured in FIG. 31. Before the water level in the tank lowers to the working level of the float bowl 3, the float bowl 3 keeps in floating state, the hanging portion 74 of the slide block 71 still hangs to the protruding portion 41 of the control rod 4, the control rod 4 does not fall down, the water stop plate 2 still keeps in open. When the water level in the tank is lower than the working level of the float bowl 3, the float bowl 3 moves down, making the driving component 73 rotate in the counter clockwise direction (as figured in FIG. 32) and push the slide block 71 to slide horizontally in the direction away from the control rod 4, making the control rod 4 escape from the restriction of the slide block 71 and the torsion spring 72 store energy, as figured in FIG. 33. During this process, the control rod 4 moves down due to the gravity and drives the water stop plate 2 to rotate in the reverse direction till the internal waterway of the water supply pipe 1 is closed; the inlet valve keeps inlet, most of flushing water is stored in the toilet tank through the connecting opening 12 of the water supply pipe 1, a small amount of flushing water flows to the flushing ring passage of the toilet through the water replenishing passage 12 to replenish water to the toilet.

During the water storing process, water level in the tank gradually raises. When the water level in the tank is higher than the lowest working level of the float bowl 3, the float bowl 3 floats up until it completely floats up; with the floating of the float bowl 3, the driving component 73 gradually rotates in the clockwise direction, at the same time, the torsion spring 72 stores energy to push the slide block 71 to slide horizontally in the direction closing to the control rod to reset, as figured in FIG. 34. At this time, as the inlet valve still inlets water, it provides a push force for the water stop plate 2 to restrict the rotating of the water stop plate 2 and indirectly provides a pull force of downward for the control rod 4, and with the gravity of the control rod, the water supply pipe 1 keeps in close, the tank continuously stores water.

Figure 34:
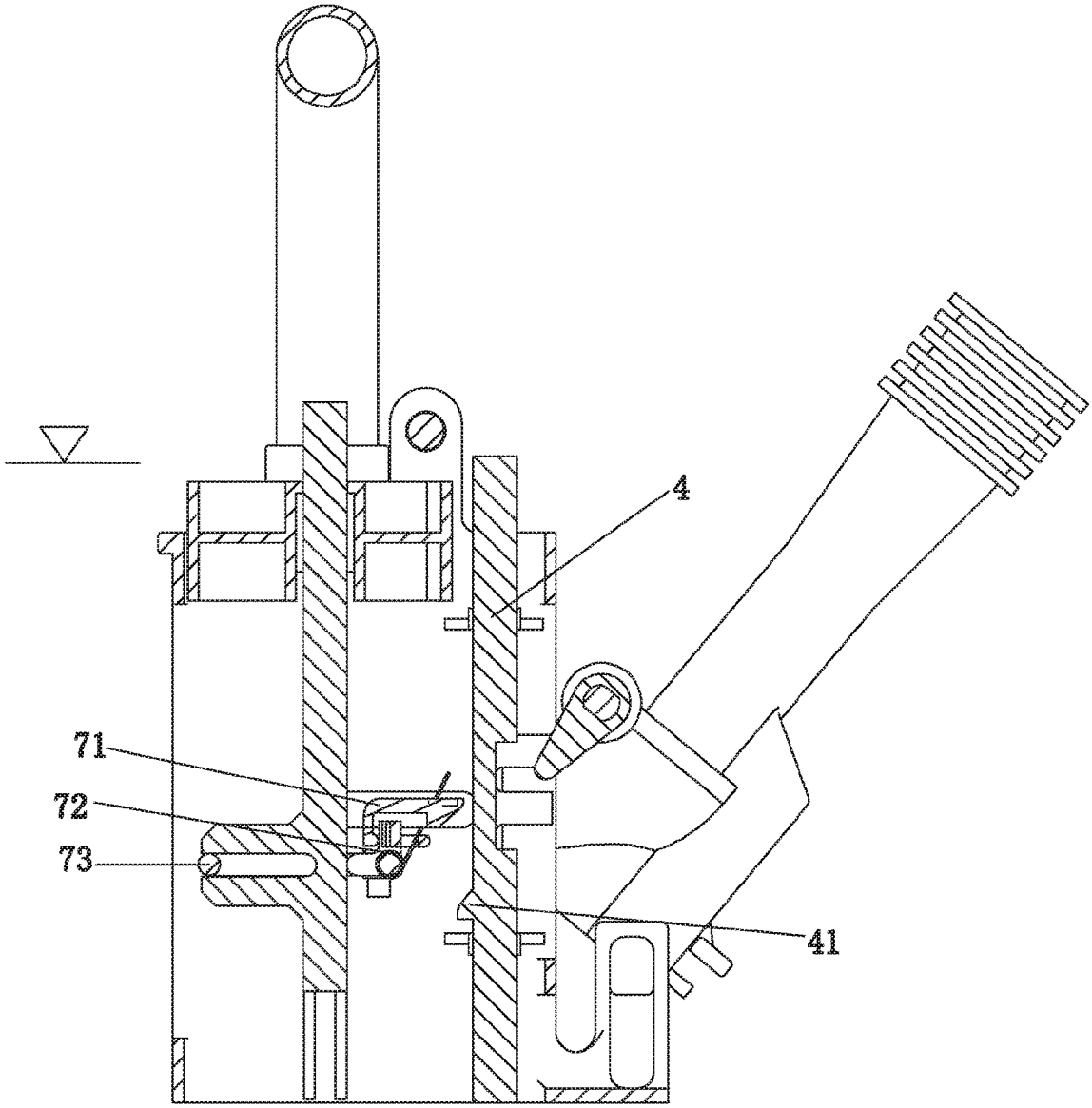
FIG. 34 illustrates a sectional diagram of the eighth embodiment of the present invention after the water is stored.

After water storing finishes, the impact force of the inlet water of the inlet valve to the water stop valve 2 disappears, the control rod 4 still keeps in the lowest position due to the gravity, the water stop plate 2 keeps in closing the internal waterway of the water supply pipe 1 for next time's discharge, as figured in FIG. 34.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention can stably control the water supply volume of the flushing ring passage of the toilet, the inlet pressure change influences only a little. Based on a satisfied flushing effect, the present invention has advantages of stable water supply volume and free of working pressure with the same inlet valve and discharge valve.

The invention claimed is:

1. A bowl flushing control device of low tank type toilet, wherein comprising:

a water supply pipe used to supply flushing water from an inlet valve and the toilet tank to the flushing ring passage or the connecting pipes, the water supply pipe is disposed with a working chamber, the working chamber connects the waterways at two sides of the water supply pipe and the toilet tank;

a waterway switch component rotatably assembled to the working chamber to open and close the waterway of the water supply pipe, the flushing water is stored in the toilet tank when the waterway switch component closes the waterway of the water supply pipe;

a first floater disposed in the toilet tank, the first floater takes action when the water level in the water tank is lower than the working level;

a control rod being movably coupled to the first floater, the first floater restricts the control rod from moving downwardly before the first floater takes corresponding action; the control rod is movably connected to the waterway switch component to move downwardly and drive the waterway switch component to close the waterway of the water supply pipe when the first floater takes off restriction on the control rod;

an activation component being coupled to the control rod to control the control rod to move upwardly to reset and to drive the waterway switch component to open the waterway of the water supply pipe.

2. The bowl flushing control device of low tank type toilet according to claim 1, wherein further comprising a water replenishing structure to replenish water to the toilet; the water replenishing structure comprises a water replenishing hole at the waterway switch component, or the water replenishing structure comprises two water replenishing passages; two ends of each water replenishing passage are respectively connected to the corresponding waterways at two sides of the working chamber of the water supply pipe; a water replenishing adjusting piece is assembled at the water replenishing passage to adjust the water area of the water replenishing passage.

3. The bowl flushing control device of low tank type toilet according to claim 1, wherein the waterway switch component is a water stop plate, the axis of the water stop plate is parallel to the rotating axis of the water stop plate; the side surface of the water supply pipe is disposed with a connecting hole, the connecting hole is disposed at the front side of the working chamber and connects to the toilet tank and the working chamber.

4. The bowl flushing control device of low tank type toilet according to claim 3, wherein the water stop plate is fanshaped, the shape of the working chamber of the water supply pipe is coupled to shape of the water stop plate, the center of circle of the water stop plate is rotatably connected to the corresponding position of the working chamber to make the water stop plate rotate out of the working chamber or rotate into the working chamber through the side surface of the working chamber; the center of circle of the water stop plate is extending with a first connecting portion, the first connecting portion is movably connected to the control rod.

5. The bowl flushing control device of low tank type toilet according to claim 1, wherein the waterway switch component is a water stop plate, the axis of the water stop plate is vertical to a rotation axis at one side of the water stop plate, the rotation axis of the water stop plate is movably connected to the control rod; the side surface of the water supply pipe is disposed with a connecting hole, the connecting hole is disposed at the front side of the working chamber and connects the toilet tank and the working chamber.

6. The bowl flushing control device of low tank type toilet according to claim 1, wherein further comprising a rack disposed in the toilet tank, the first floater is rotatably assembled to the rack and is rotatable when the water level in the toilet tank is lower than the working level; the control rod is movably assembled to the rack.

7. The bowl flushing control device of low tank type toilet according to claim 6, wherein the side surface of the control rod is disposed with a protruding portion, the first floater is disposed with a hook to hang to the protruding portion, the hook hooks the protruding portion before the first floater rotates so as to restrict the control rod from moving downwardly.

8. The bowl flushing control device of low tank type toilet according to claim 1, wherein further comprising a rack disposed in the toilet tank, the first floater is longitudinally movably assembled to the rack and moves downwardly when the water level in the toilet tank is lower than the working level; further comprising a transmission mechanism, the first floater is movably coupled to the control rod by the transmission mechanism; the control rod is movably assembled to the rack.

9. The bowl flushing control device of low tank type toilet according to claim 8, wherein the transmission mechanism comprises a slide block horizontally slidably assembled to the rack, a driving component rotatably assembled to the rack and an elastic element; the side surface of the control rod is disposed with a protruding portion, the slide block is disposed with a hanging portion to hang to the protruding portion; the first floater is once formed with a guide rod or is fixedly connected with a guide rode; one end of the driving component is rotatbly connected to the guide rod, the other end of the driving component is movably connected to the slide block to make the first floater push the slide block to move that makes the hanging portion of the slide block separate from the protruding portion when the first floater moves downwardly; the slide block is reset by the elastic element.

10. The bowl flushing control device of low tank type toilet according to claim 1, wherein the activation component is a second floater connected to the control rod or a second floater once formed to the control rod.

11. The bowl flushing control device of low tank type toilet according to claim 1, wherein the activation component is a pull rod linked to the discharging operation mechanism of the toilet, the pull rod is synchronously coupled to the control rod.

12. The bowl flushing control device of low tank type toilet according to claim 11, wherein the pull rod is rotatably connected to the top portion of the rack, the pull rod is disposed with a second connecting portion at the radial direction of the rotating shaft; the second connecting portion is disposed with an elongate hole, the side surface of the top portion of the control rod is disposed with a pin shaft, the pin shaft is slidably inserted to the second elongate hole.

13. The bowl flushing control device of low tank type toilet according to claim 1, wherein the waterway of the water supply pipe corresponding to the front side of the working chamber is disposed with a spraying nozzle, and/or the waterway of the water supply pipe corresponding to the front side of the working chamber is disposed with a relief valve.

* * * * *